US006786399B2

(12) United States Patent
Abe et al.

(10) Patent No.: US 6,786,399 B2
(45) Date of Patent: Sep. 7, 2004

(54) BANKNOTE RELEASE AND STORAGE APPARATUS

(75) Inventors: Hiroshi Abe, Iwatsuki (JP); Joji Iida, Hachiouji (JP)

(73) Assignee: Asahi Seiko Co., Ltd., Tokyo (JP)

( * ) Notice: Subject to any disclaimer, the term of this patent is extended or adjusted under 35 U.S.C. 154(b) by 16 days.

(21) Appl. No.: 10/267,442

(22) Filed: Oct. 9, 2002

(65) Prior Publication Data

US 2003/0080488 A1 May 1, 2003

(30) Foreign Application Priority Data

Oct. 9, 2001 (JP) ..... 2001-311990

(51) Int. Cl.[7] ..... G06F 17/60
(52) U.S. Cl. ..... 235/379
(58) Field of Search ..... 235/379, 380, 235/382, 375, 475, 479; 902/14, 15, 17, 36; 221/13, 21, 245

(56) References Cited

U.S. PATENT DOCUMENTS 4,020,972 A 5/1977 Lundblad ..... 222/13
4,095,781 A * 6/1978 Kistner et al. ..... 271/12
4,168,058 A * 9/1979 Granzow et al. ..... 271/5
6,196,457 B1 * 3/2001 Patterson ..... 235/379
6,276,603 B1 * 8/2001 Patterson ..... 235/379

FOREIGN PATENT DOCUMENTS

GB 2 196 323 A * 4/1988
JP 11175804 7/1999

* cited by examiner

*Primary Examiner*—Thien Minh Le

(57) ABSTRACT

A banknote release and storage apparatus is provided for both discharging banknotes from a safe and for re-inserting a banknote through the same discharge opening back into the safe. A stacked array of banknotes can have the lower-most banknote discharged through an opening for dispensing to a user. Conversely, a banknote returned to the same discharge opening can be re-inserted when a lifting unit lifts one end of the stacked array of banknotes to create a receptive storage space and a let-off device is driven in a reverse direction for drawing the banknote back into the storage unit.

24 Claims, 19 Drawing Sheets

BANKNOTE RELEASE AND STORAGE APPARATUS

BACKGROUND OF THE INVENTION

1. Field of the Invention

This present invention is an improvement in a compact banknote accepting device which can automatically accept a banknote for storage in a safe. More particularly, this present invention relates to the banknote accepting device which can efficiently store a large number of banknotes in a compact safe for dispensing and subsequently for returning a banknote to the safe.

2. Background of the Invention

A compact banknote accepting device is known in Japanese Laid-Open patent specification No. 11-175804. In this prior art, when a banknote is accepted in a safe, the banknotes on a supporting board in the safe are pushed downward by a pushing board which is located over the safe. Therefore an opening is created over the banknotes. A banknote is transported to this opening and is stored. The banknote which is transported by a transporting device outside the safe doesn't receive a transporting-force at the opening. Therefore the opening has to include enough space and sufficient planar surfaces, to permit the banknote to lie flat. Previously, banknotes were generally bent when they were stored. Therefore, when such banknotes are dispense problems can occur.

SUMMARY OF THE INVENTION

The purpose of this invention is stop the folding of the banknotes in the safe. More particularly, a first purpose of the present invention is to prevent the storing of bent banknotes in the safe.

A second purpose of this present invention is to downsize the banknotes accepting device which stores the banknotes to a compact efficient structure.

The banknote accepting device includes a safe which stores banknotes and has a dispensing slot, a banknote drawing device which is located in the safe and a lifter unit which is positioned apart from the banknote drawing device banknotes in the safe. Banknotes are transported to a predetermined section by the banknote drawing device. The banknote is pulled by the banknote drawing device to be transported to a predetermined section. The lifter unit faces an end of the banknote at the dispensing slot side. The lifter unit pushes up only the front of the banknotes and disengages the banknotes from the drawing device. As a result, this present invention has a simple structure with low energy consumption and can permit a return of a recycled banknote.

The present invention includes a one-by-one dispensing device which is located upstream from the dispensing slot. In this structure, the banknotes are stored in the safe one by one, as it only receives the banknotes.

When the banknotes are pushed up, the base of the banknotes have contact with the drawing device. Therefore the received banknote can be drawn back into the safe smoothly. This present invention is desirable, because it has a safe which includes a let-off device, thereby the banknotes are efficiently transported from the entry. The safe can be used as both a banknote dispensing and accepting device, because the banknotes in the safe are dispensed by the let off device, which includes a rotating direction changeable device which can change the direction of the banknote drawing device to again recapture a banknote for entry back into the safe. In such a structure, the drawing device can become a let-off device, because of the rotating direction changeability. Therefore, the banknote accepting and dispensing device can be made in a compact configuration.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENT

The following description is provided to enable any person skilled in the art to make and use the invention and sets forth the best modes contemplated by the inventors of carrying out their invention. Various modifications, however, will remain readily apparent to those skilled in the art, since the general principles of the present invention have been defined herein specifically to provide a banknote release and storage apparatus.

As can be appreciated, the term "bill" or "banknote" has been used generically to define a flat sheet usually of paper or a composite material which can be stacked in an array for storage and dispensed, for example, from a cash dispensing machine. Thus, the term "bill" or "banknote" can embrace a sheet, check, certificate, coupon ticket, exchange ticket, or various types of monetary instruments.

Figure 1:
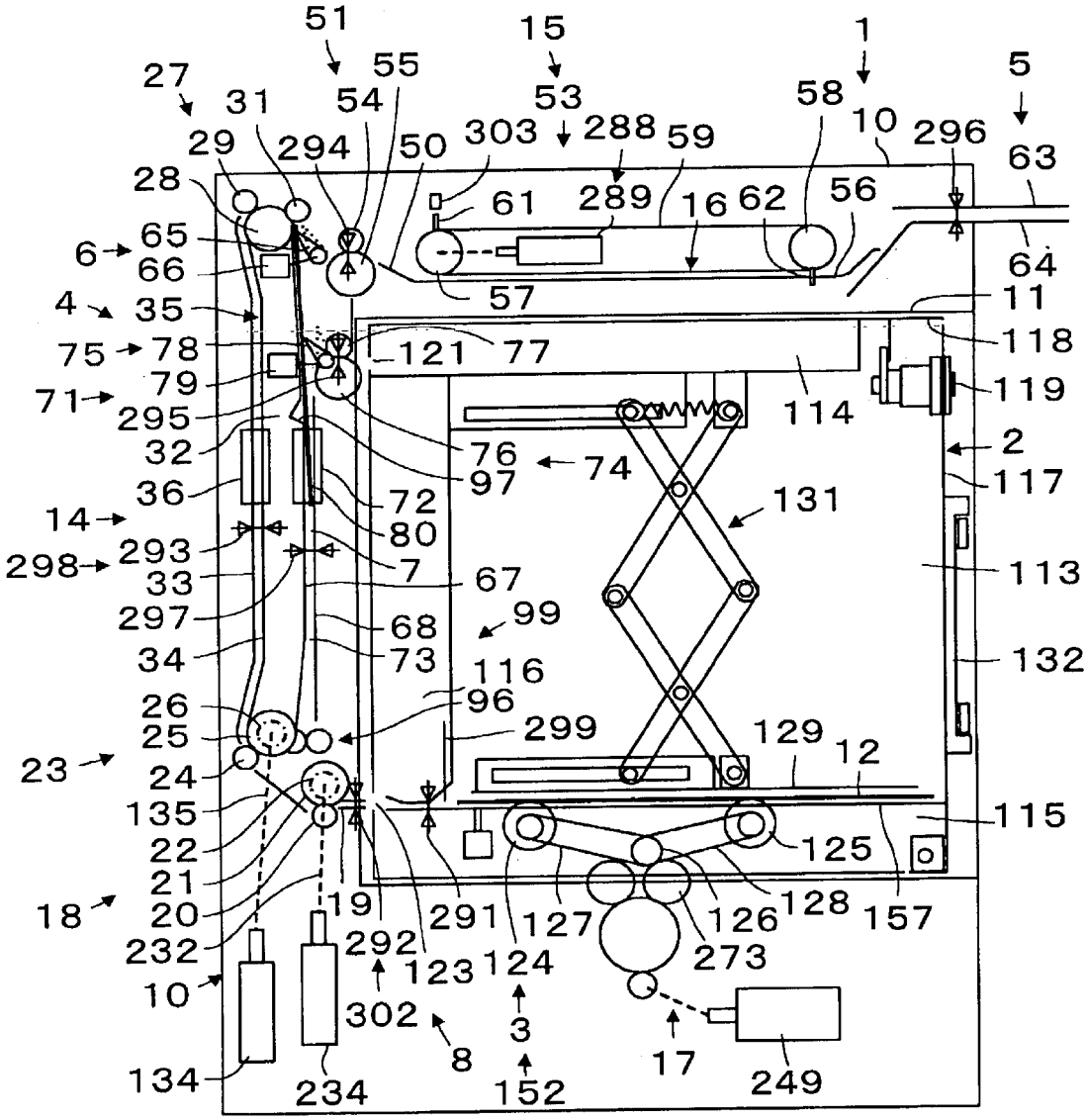
FIG. 1 is an overview schematic diagram of an embodiment of the present invention.

The banknote dispensing device 1 is explained by referring to FIG. 1. Safe 2 has a box-like configuration and is placed at a storing section 11 in a body 10. A transporting device 4 can transport banknotes 12 from the safe 2 to a dispensing slot 5 in response to a dispensing signal and includes a first transporting device 14 which is located along one side of the storing section 11 and a second transporting device 15 which is located over the storing section 11.

The first transporting device 14 transports the banknote 12 in a vertical direction after discharge from the safe 2. A storing device 16 temporarily stores the banknotes 12 which are received from the first transporting device 14 and the banknotes 12 are stored in a horizontal position. A second transporting device 15 transports banknotes 12 that are accumulated in the horizontal position. The storing device 16 is located between the second transporting device 15 and the storing section 11.

A recycling device 8 is located between the storing section 11 and the first transporting device 14 and is aligned vertically with the first transporting device 14.

A diverting device 6 is located between the first transporting device 14 and the second transporting device 15 and can divert the banknotes 12 to either the second transporting device 15 or a recycling passage 7, if it is determined not to discharge the banknote, e.g., a duplicate banknote is erroneously issued from the safe 2.

The first transporting device 14 includes a first transporting roller unit 18 which is located adjacent to a receiving slot 19 beside the storing section 11. A first press roller 20 of the first transporting roller unit 18 has a small diameter and is resiliently pressed adjacent a first roller 21 which has a larger diameter. A first gear 22 is fixed at a side surface of the first roller 21.

A second transporting roller unit 23 is located above the first transporting roller unit 18 and is offset to one side. A second press roller 24 of the second transporting roller unit 23 has resilient contact with a second roller 25. A second gear 26 is fixed at the side surface of the second roller 25.

Figure 2:
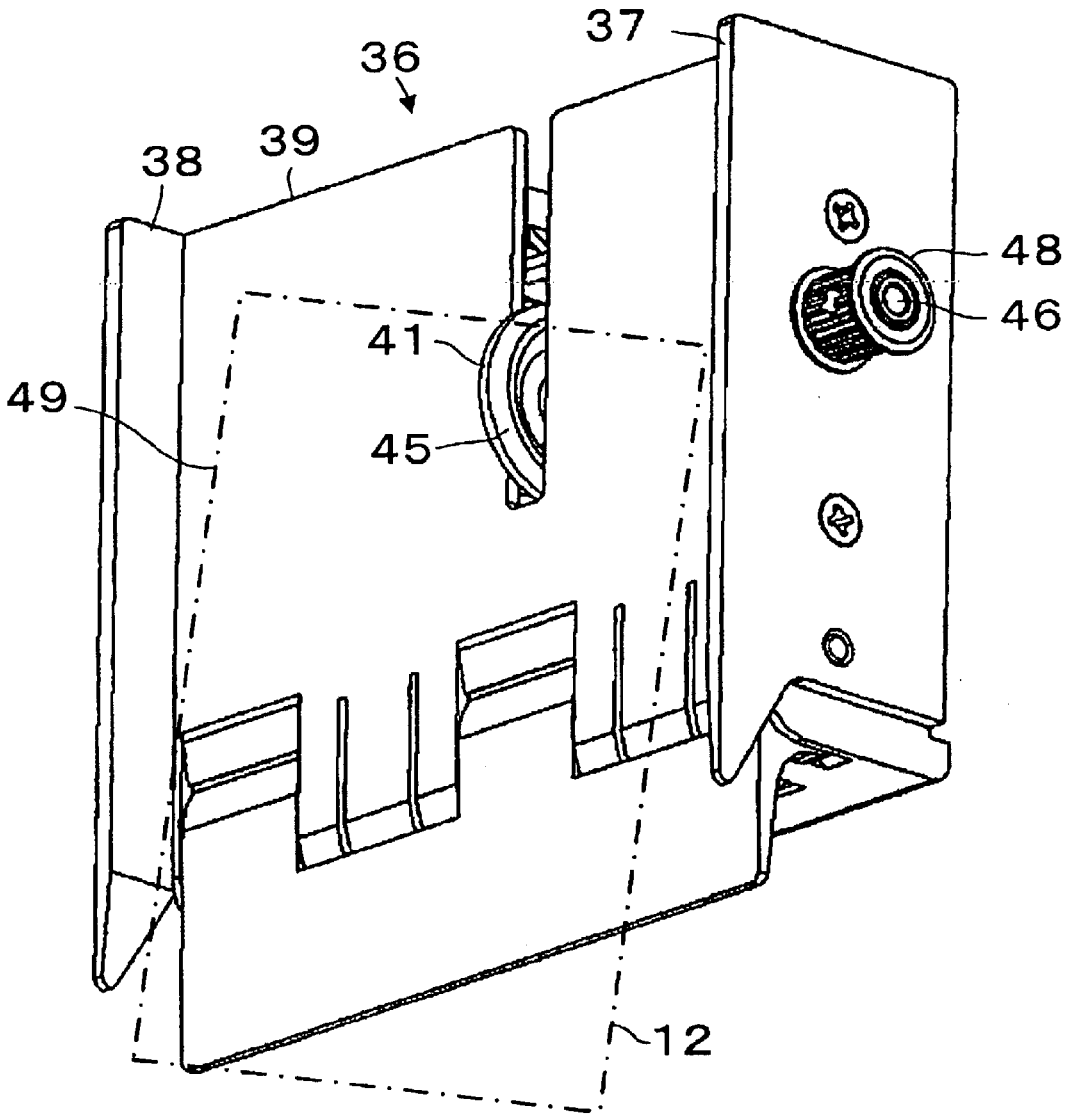
FIG. 2 is a perspective view of a first arraying device.

A third transporting roller unit 27 is located over the second transporting roller unit 23 and is located above the storing section 11. The third transporting roller unit 27 includes a third roller 28 which has a large diameter, a third press roller 29 which has contact with the upper section of the center of the third roller 28 and a fourth press roller 31. A first guiding board 32 is located between the second roller 25 and the third roller 28. A second guide board 33 is plate-like in shape and is located at a predetermined position which is away from a first guiding board surface 34. A first transporting passageway 35 extends between the first guide board surface 34 and the second guiding board 33. A first arraying device 36 is located at the middle section of the first transporting passage 35 and can align and guide a banknote to a desired reference plane. As shown in FIG. 2, the first arraying device 36 has a second guide wall 37 and a third guide wall 38 which are both located to extend perpendicular to the ends of a first guide wall 39 which is located adjacent the first guiding board 34. The first guide wall 39 forms part of the structure of the second guide board 33. A first arraying roller 41 is rotatable and is supported to extend through the first guiding wall 39 which is between the second guide wall 37 and the third guide wall 38.

Figure 3:
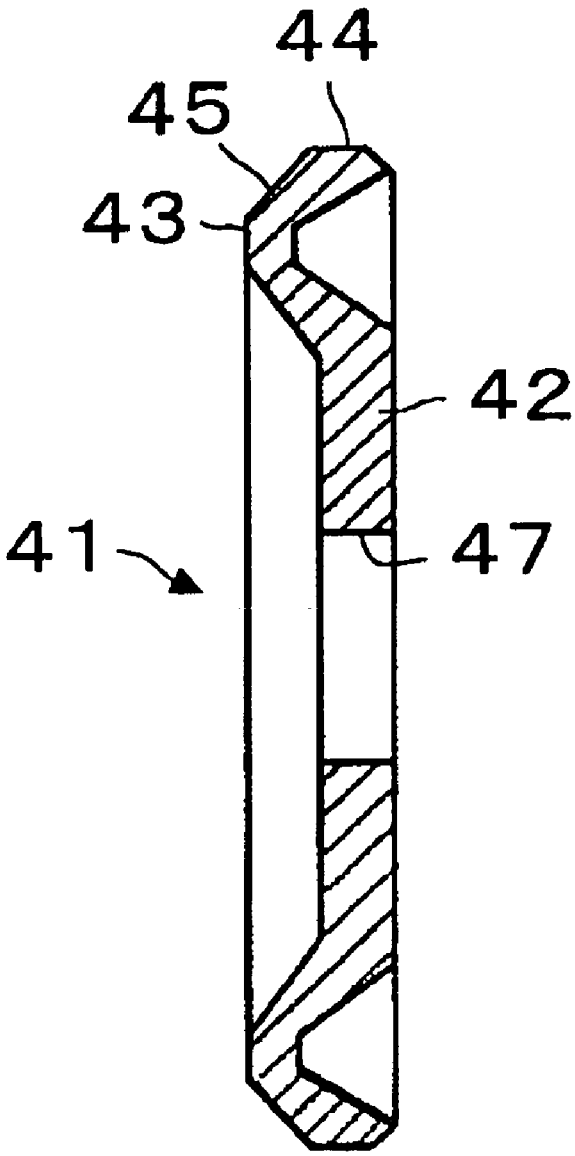
FIG. 3 is the cross-section view of a first arraying.

As shown in FIG. 3, the first arraying roller 41 has a central circular plain section 42 and a peripheral V-cross-section 43 which is located around the circular plain section 42. The V-cross-section 43 has another cylindrical section 44 which is parallel to the rotating axis of the roller 41. Finally, a slanting section 45 is provided adjacent the outer section 44. The first arraying roller 41 can be made from polyurethane and has elasticity. It is fixed on a rotating shaft 46 which extends through a supporting hole 47. A timing pulley 48 is fixed at the end of the rotating shaft 46. The timing pulley 48 is driven via a belt (not shown) by a driving source. The first arraying roller 41 is pressed to the first guiding board 34. Therefore, a cylindrical section 44 and a slanting section 45 are transformed and can have contact with the banknotes 12.

The peripheral speed of the cylindrical section 44 is larger than the speed of the slanting section 45 to transform the first arraying roller 41. Therefore, the lower edge of the banknote 12 is pressed to the third guide wall 38 because the banknote 12 pivots in a clockwise direction, as shown in FIG. 2. Next, a side edge 49 of the banknote 12 has contact with the third guide wall 38, and as a result, it is arrayed along the third guide wall 38.

The second transporting device 15 includes a fourth transporting roller 51, the storing device 16 and a package dispensing device 53. The fourth transporting roller 51 is located above the storing section 11 and to the right of the first transporting device 14, as shown in FIG. 1. A fifth press roller 54 of the fourth transporting roller 51 has resiliently contact with a fourth roller 55.

Next, the storing device 16 which is adjacent the dispensing slot 5 is explained. A tray 50 is located above the storing section 11 and on the right of the fourth transporting roller 51. The tray 50 is dish-like in shape and has a concave portion 56 at the center. The length of the concave portion 56 is slightly longer than a banknote 12. The banknote 12 is temporarily stored at the concave portion 56.

Next, the package dispensing device 53 is explained. A pair of guiding roller 57 and 58 are located over the concave portion 56 and slightly away from the concave portion 56 to permit a plurality of banknotes to be accumulated.

First, a belt 59 is positioned around to the guide rollers 57 and 58. A first projection 61 and a second projection 62 are fixed at the outer surface of the belt 59. The distance between the projections 61 and 62 is the same. The lower surface of the first belt 59 is parallel to the concave portion 56 of the tray 50. The projection 61 and 62 can push the accumulated banknotes in the tray towards the dispensing slot 5.

Next, the banknote dispensing slot 5 is explained. Guiding boards 63 and 64 are located above and to the right of the storing section 11 and connected to the second transporting device 15. Boards 63 and 64 are spaced by a predetermined distance and have left ends made up in a V-shape.

Next, the diverting device 6 is explained. The diverting device 6 is located between the third transporting roller 27 and the fourth transporting roller 55 and includes a diverting board 65 and a first solenoid 66 which pivots the diverting board 65. When the first solenoid 66 is demagnetized, the banknotes 12 are guided to the recycling passage 7 by the diverting board 65. On the other hand, when the first solenoid 66 is excited, the banknotes 12 are guided to the fourth transporting roller 51.

Next, the recycling passage 7 is explained. The recycling passage 7 includes a first guiding board reverse side 67 and a third guiding board 68 which is a predetermined distance away from the reverse side 67. The recycling passage 7 is located between the first transporting device 14 and the storing section 11 and is approximately vertically aligned. A rejecting device 71, a second arraying device 72, a recycle storing device 73, and the recycling device 8 are located at the recycling passage 7 and are arrayed downwards.

Next, the rejecting-device 71 is explained. The rejecting device 71 includes a reject transporting roller 74 and a reject diverting device 75. The reject transporting roller 74 is located between the upper section of the storing section 11 and the first transporting device 14. The reject transporting roller 74 includes a sixth pressing roller 77 which is small in diameter has resilient contact with a fifth roller 76 which is larger in diameter.

The reject diverting device 75 includes a reject guiding board 78 and a second solenoid 79. The reject guiding board 78 is located between the first guiding board 32 and the reject transporting roller 74. Recycling banknotes 80 are guided to the reject transporting roller 74 or the recycle storing device 73 by the reject guiding board 78.

When the second solenoid 79 is unexcited, the reject guiding board 78 is located at the first guiding board 32 side. Therefore, the recycling banknote 80 is guided to the reject transport roller 74. When the second solenoid 79 is excited, the reject guiding board 78 moves. Therefore, the recycling banknote 80 is guided to the recycling storing device 73.

Figure 4:
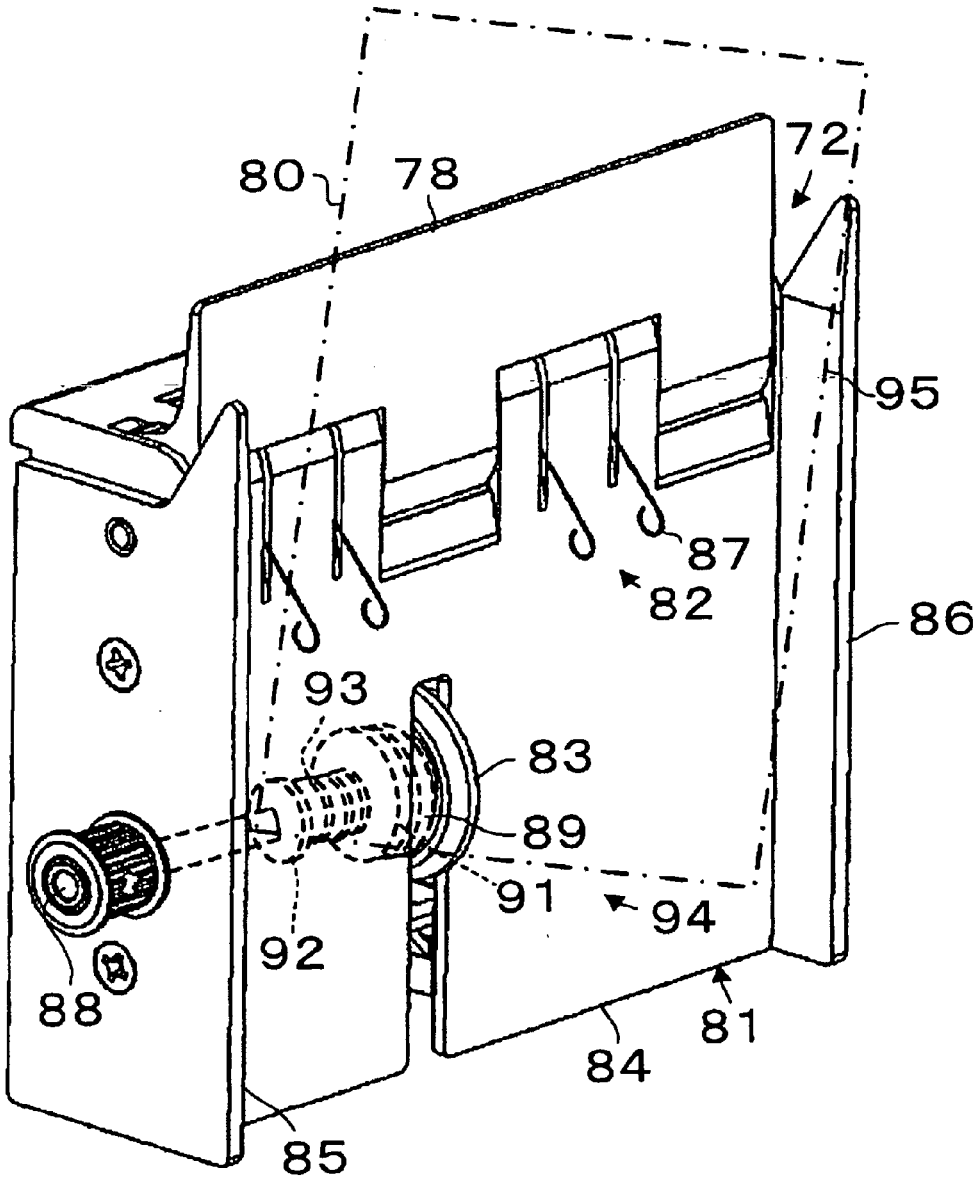
FIG. 4 is a perspective view of a second arraying device.

The second arraying device 72 is explained by referring to FIG. 4. The second arraying device 72 is nearly the same as the first arraying device 36. The second arraying device 72 is located near the downstream of the reject transporting roller 74. The reject guiding board 78 is mounted at the upper section of body 81 of the second arraying device 72 and is rotatable. The second arraying device 72 includes a bias device 82, a second arraying roller 83, a first guiding wall 84, second guiding wall 85, and a third guiding wall 86.

As shown in FIG. 4, the bias device 82 has a top with a ring-shape which is a wire spring 87 and its root is fixed at body 81. The top of the wire spring 87 is located at the recycling passage 7. The wire spring 87 can be four in number and they are located at predetermined distances and are parallel to each other.

The second arraying roller 83 is located downstream of the bias device 82 and is supported on a rotating shaft 88 and is the same shape as the first arraying roller 41. A friction disc 89 is fixed on the second arraying roller 83. A second friction disc 91 is located adjacent to the friction disc 89 and is rotatable on the rotating shaft 88. A second friction disc 91 is pushed toward the friction disc 89 by a spring 93 which is located between a stopper 92 which is fixed on the rotating shaft 88 and the friction disc 89. A friction clutch 94 includes the friction disc 89 and the second friction disc 91.

A rotating shaft 88 is rotated by a driving source (not shown). The recycling banknotes 80 are transported downwards and are pushed to the third guiding wall 86, and the first guiding board reverse side 67 by the wire spring 87 at the second arraying device 72. The side edge 95 of the recycling banknotes 80 is pushed to the third guiding wall 86 by the second arraying roller 83, and as a result, and they are transported to a one by one dispensing device 96.

When a recycling banknote 80 is stopped by the one by one dispensing device 96, the recycling banknote 80 has contact with the second arraying roller 83. In this situation, the recycling banknote 80 is stalled, because when the friction force between the second arraying roller 83 and the recycling banknote 80 is over a predetermined force, the friction clutch 94 slips, and as a result, the second arraying roller 83 does not slip relative to the recycling banknote 80.

A slanting surface 97 is located at the first guiding board reverse side 67 (shown in FIG. 1). The recycling banknotes 80 are guided to the base of the wire spring 87 by the slanting surface 97.

Next, the recycling device 8 is explained. The recycling device 8 includes the one by one dispensing device or sorting device 96 and a receiving device 99. The one-by-one dispensing device 96 is located below the recycling passage 7.

Figure 5:
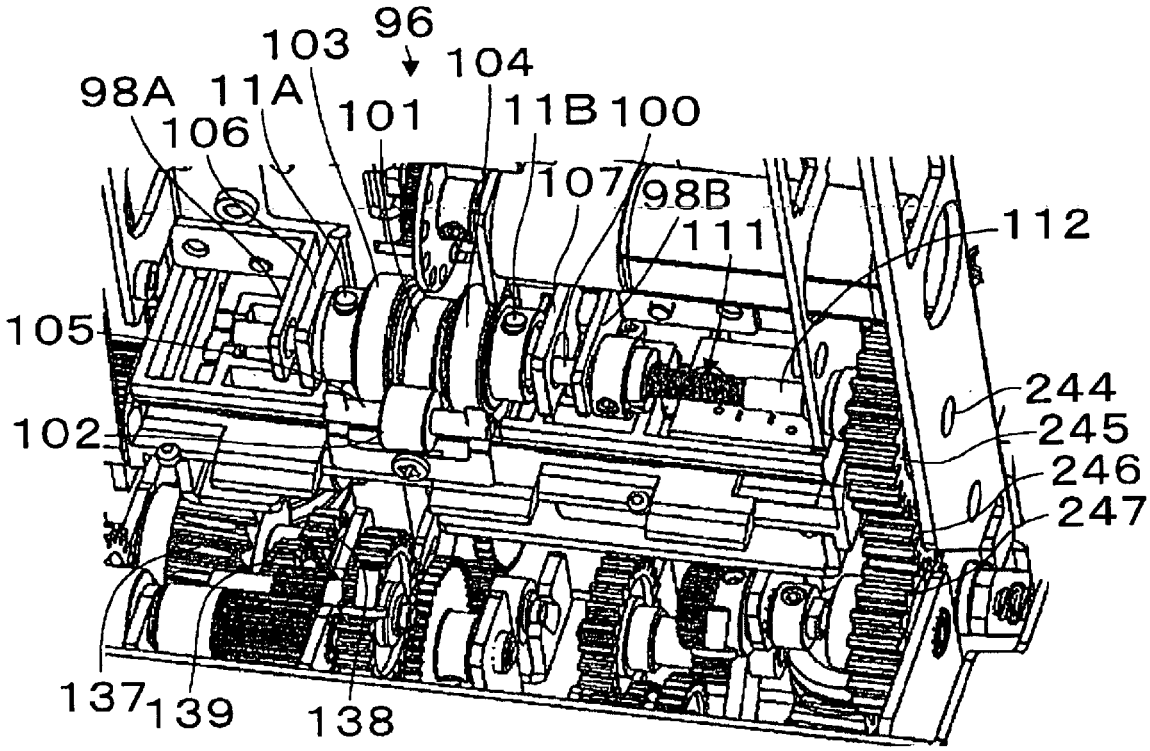
FIG. 5 is a perspective view of a one-by-one dispensing device.
Figure 6:
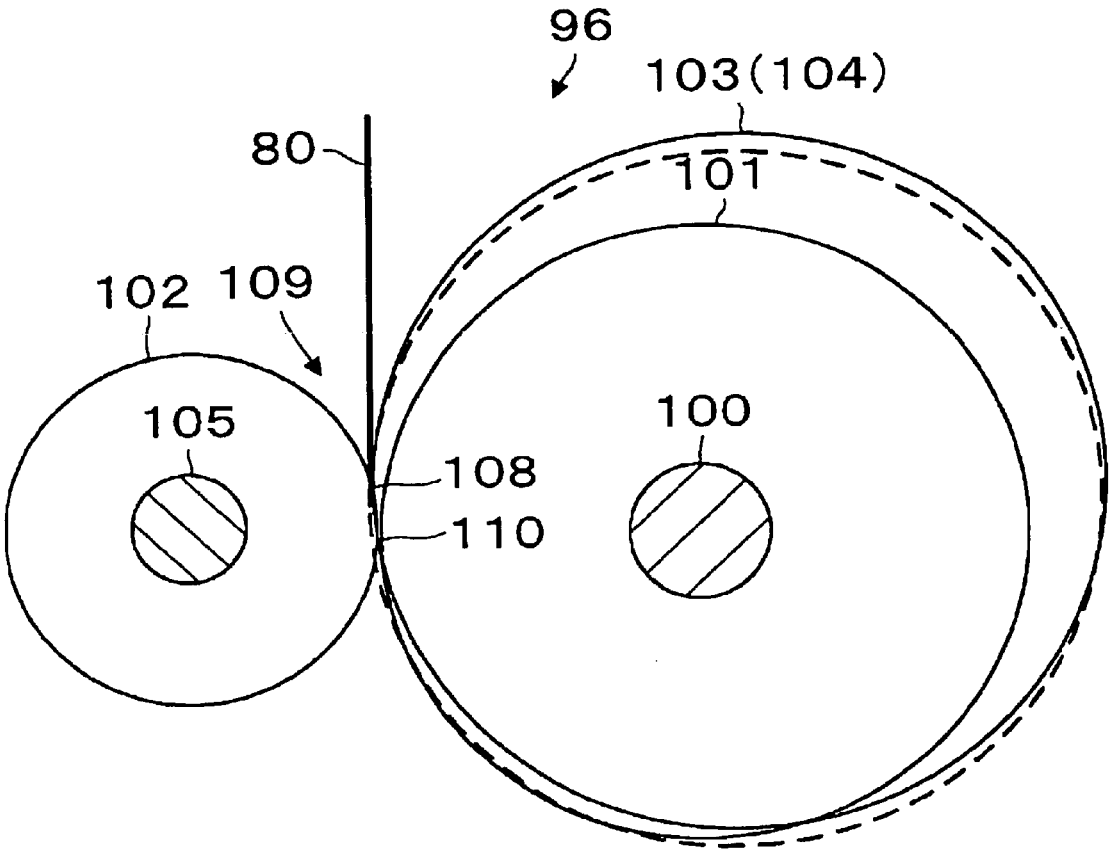
FIG. 6 is a schematic cross-section view of the one-by-one dispensing device.

The one-by-one dispensing device 96 is explained by referring to FIG. 5 and FIG. 6. It includes a roller 101 which is fixed on a shaft 100, a seventh pressing roller 102 which has contact with the roller 101 and fixed rollers 103 and 104 which are larger in diameter than the roller 101. The fixed rollers 103 and 104 are provided as a resistance guide. The seventh pressing roller 102 is rotatable supported on a shaft 105. The surface of the seventh pressing roller 102 has a relatively high friction, because it is to draw smoothly. The seventh pressing roller 102 is made from ethylene propylene rubber (EPDM). The seventh pressing roller 102 can be made up of metal and the surface can be satin finished.

The fixed roller 103 is fixed on a stay 106, and fixed roller 104 is fixed on a stay 107. The fixed rollers 103 and 104 are eccentrically positioned relative to the shaft 100 and can be changed to a rotating position (the dotted line shown in FIG. 6). Fixed rollers 103 and 104 are made from hard polyurethane rubber. The hard polyurethane rubber has a long life, a high friction coefficient, and is inexpensive. Alternatively, the fixed rollers 103 and 104 can be made up of metal with a high friction surface.

The fixed rollers 103 and 104 and the seventh pressing roller 102 make up the overlap section 108 having a side cross-section wedge shape for receiving the banknotes. A banknote receiving section 109 is located over an overlap section 108 and is wedge-shaped for receiving the entrance edge of the banknote. The fixed rollers 103 and 104 are fixed on the stay 106 and 107 by screws 11A and 11B.

As shown in FIG. 5, the fixed rollers 103 and 104 are located away at a 0.5 mm distance from the side of the seventh press roller 102. The round surface of the roller 101 has contact with the round surface of the seventh press roller 102 and are eccentric to shaft 100. A contact section 110 is located below the overlap section 108 which is overlapped by the seventh press roller 102 and the fixed rollers 103 and 104.

The recycling banknotes 80 are transported from the second arraying device 72, and are stopped by the overlap section 108. The shaft 100 is rotatable on a shaft bearing 98A and 98B. The shaft 100 is rotated through a one-way clutch 111 by a driving shaft 112.

Figure 7:
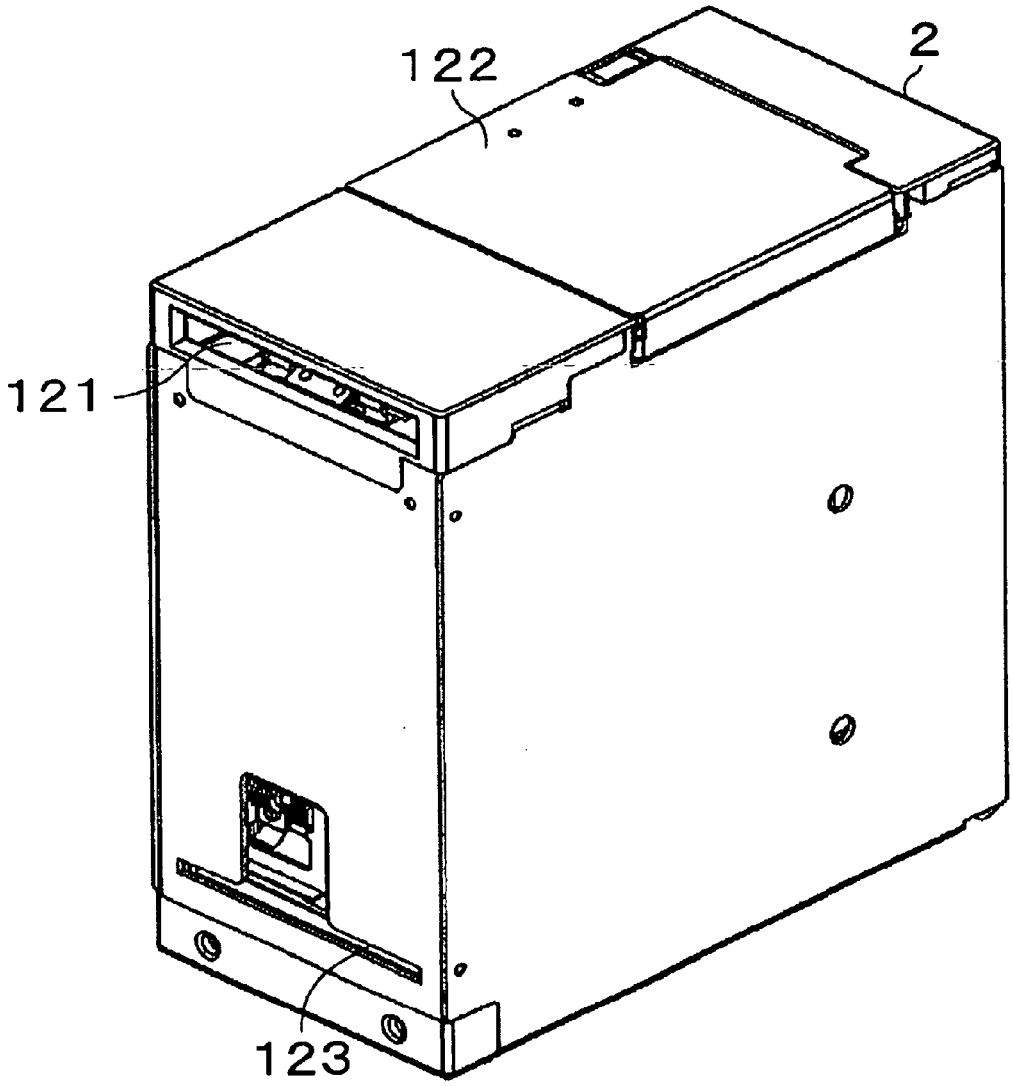
FIG. 7 is a perspective view of the safe of the present invention.

Next, the safe 2 is explained referring to FIG. 1 and FIG. 7. The safe 10 has a storing section 113 which is located in the middle, a reject storing section 114 which is located in the upper section, a unit section 115 which is located under the storing section 113, and a shutter section 116 which is located at one side. A lid 117 is hinged to a frame 118, and the storing section 113 is opened or closed. The lid 117 is locked to the frame 118 by the key 119.

The reject storing section 114 is connected to a receiving slot 121 which has a rectangular configuration and is located at the horizontal extending section which is across from the nip section of the reject transporting roller 74. As shown in FIG. 7, a reject lid 122 is rectangular and is hinged over the upper section of the reject storing section 114. After the reject lid 122 is opened, the reject banknotes can be pulled out from the reject storing section 114. The reject lid 122 can be locked by a locking device (not shown).

A banknote exit opening 123 is rectangle and is located below the shutter section 116 and the side of the nipped plane of the first transporting roller 18. The banknote exit 123 provides communication with the storing section 113.

A let-off device 3 is explained by referring to FIG. 1. The let-off device 3 is located in the unit section 115 and includes rollers 124 and 125 which are located at a predetermined distance along the longitudinal direction of the banknote 12.

The upper surface of rollers 124 and 125 extend into storing section 113. Pulleys (not shown) combine with a driven gear 126 to drive the rotating rollers 124 and 125 through belts 127 and 128. A driving device 17 drives the driven gear 126. A banknote pusher 129 is located in the storing section 113 and is moved towards the rollers 124 and 125 by a parallel link mechanism 131.

A handle 132 is supported at the lid 117 for opening the lid to access the storing section 113.

Figure 8:
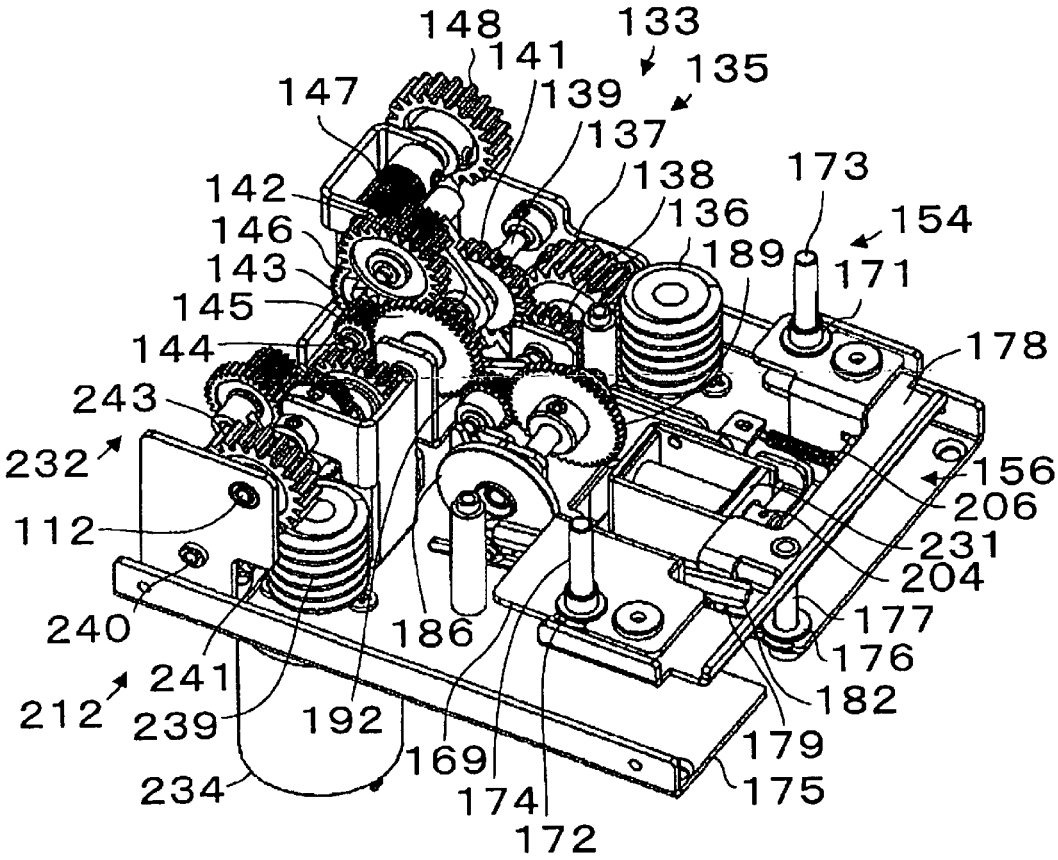
FIG. 8 is a perspective view of a driving device and transmission of the banknote dispensing device.

A driving device 133 of the first transporting roller 18 is explained by referring to FIG. 8. A first motor 134 drives the second roller 25 through a first transmission mechanism 135. As shown in FIG. 8, a worm gear 136 is fixed at the output shaft of the first motor 134 and engages with a worm wheel 137. An idler gear 138 is fixed on the shaft which is also fixed with the worm gear 136 and engages with a gear 141 which is fixed on a shaft 139. A gear 143 has contact with a torque slipping clutch 142 which is driven by the shaft 139. The gear 143 engages with a gear 145 which is rotatable on a shaft 144. A gear 146 is fixed on the same shaft as the gear 145 and engages with a gear 147. A driving gear 148 is rotated and coincides with the gear 147.

The driving gear 148 engages with the second gear 26 which is fixed on the same shaft as the second roller 25. Therefore, the second roller 25 is rotated by the first motor 134 wherein the torque range is established by the torque slipping clutch 142. The second roller 25, the fourth transporting roller 55, and the fifth roller 76 are driven by the second roller 25 through a transmitting mechanism (not shown).

Next, the receiving device 99 is explained. The receiving device 99 includes a banknote lifter 151 and a drawing device 152. The banknote lifter 151 is explained by referring to FIGS. 9 through to 11. The banknote lifter 151 includes a banknotes lifting device 153, a lifting device 154 which drives the lifting device 153, a lifting driver 155, and a driver 156.

The banknotes lifting device 153 is explained. A bracket 158 is elongated downward from the side of a bottom 157. A lever 159 pivots on a shaft 161 of the bracket 158. A pin 162 extends across to the banknote 12 and is fixed at the top of the first lever 159. A receiving section 163 is located at the middle of the first lever 159 and extends towards the left side of FIG. 9.

A second lever 164 pivots on a shaft 165 of a second bracket 160 which extends downward from the side of the bottom 157. A second pin 166 extends towards the first pin 162 and is fixed at the top of the second lever 164. The first pin 162 and the second pin 166 are located along the same axis.

A second receiving section 168 is located below the middle of the second lever 164 and extends towards the right side of FIG. 9.

The first lever 159 and the second lever 164 are always provided a predetermined torque towards the bottom 157 by a spring (not shown). At the standby situation, the first pin 162 and the second pin 166 are located below the rollers 124 and 125.

When the first lever 159 and the second lever 164 move upwards, the first pin 162 and the second pin 166 push up the lowest banknote 12. As a result, a triangle storage space is formed between the bottom 157 and the lowest banknote 12.

Figure 10:
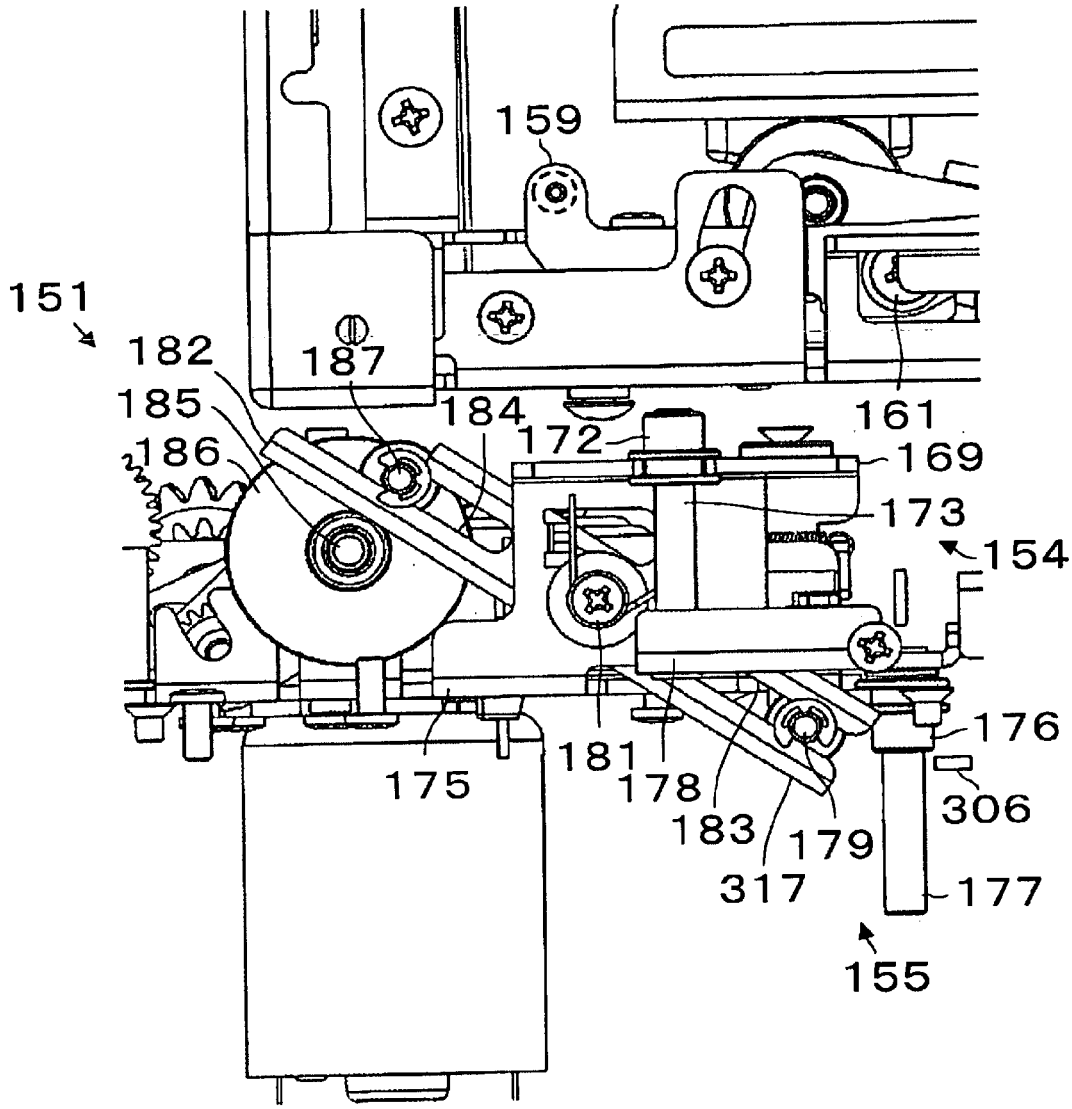
FIG. 10 is a front view of a driving device for the lifting device.

Next, the lifting device 154 of the banknotes lifting device 153 is explained with reference to FIG. 10 and FIG. 19. The lifting device 154 includes a guide base 169 which is fixed at a third bracket 175 in the unit section 115, a first pushing rod 173 which is slidable through a bushing 171 of the guide base 169, a second pushing rod 174 and a guiding rod 177 which is cylindrical and is slidable through a bushing 176 of the third bracket 175.

Figure 9:
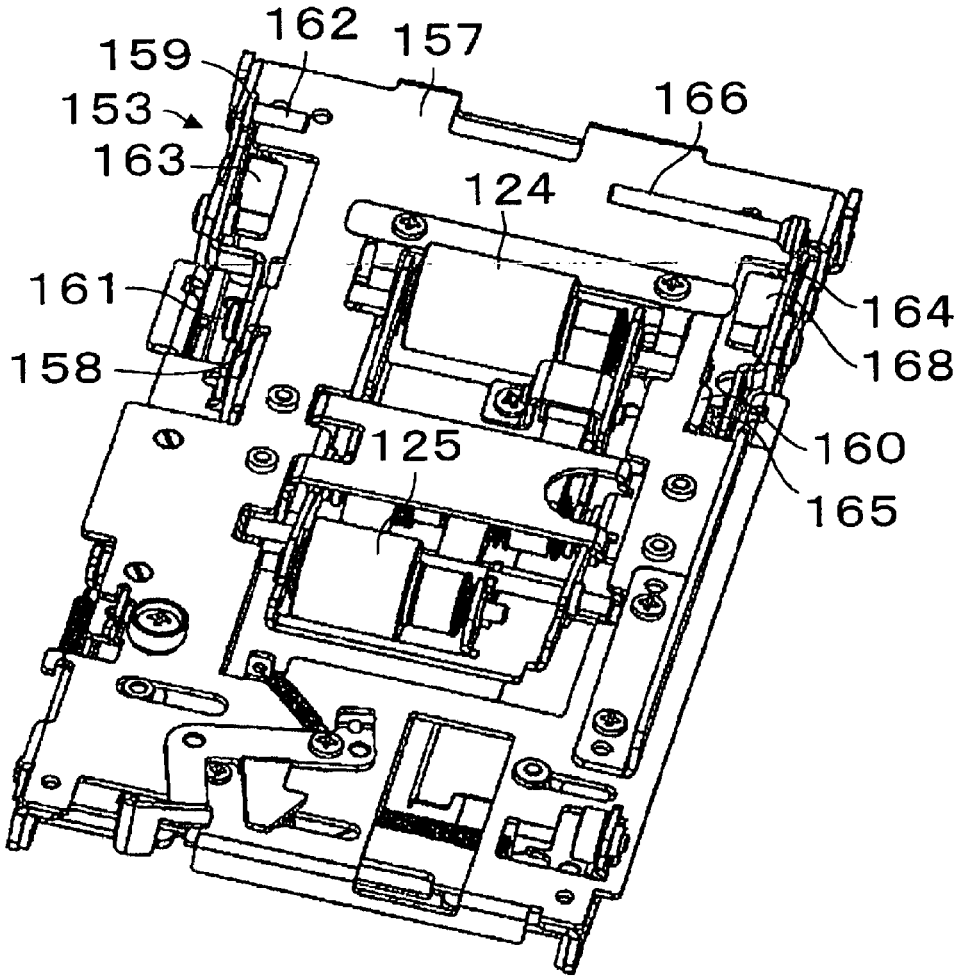
FIG. 9 is the perspective view of a lifting device.

The end of the first pushing rod 173 is located opposite the under surface of the second receiving section 168 (shown in FIG. 9). The end of the second pushing rod 174 is located opposite the under surface of the first receiving section 163 (shown in FIG. 9). The end of the second pushing rod 174 pushes up the first lever 159 and the end of the first pushing rod 173 pushes up the second lever 164. The first pushing rod 173, the second pushing rod 174, and the guiding rod 177 are fixed at a transferring base 178.

The lifting device 154 of the lifting driver 155 is explained. As shown in FIG. 10, a pin 179 is fixed at the transferring base 178. A shaft 181 is fixed at the third bracket 175. A lever 182 pivots on the shaft 181.

The pin 179 is inserted in a groove 183 and can be slideable. A pin 187 is fixed at a crank 186 which is a rotating shaft 185 and is inserted in a groove 184 of the other end of a lever 182.

Figure 11:
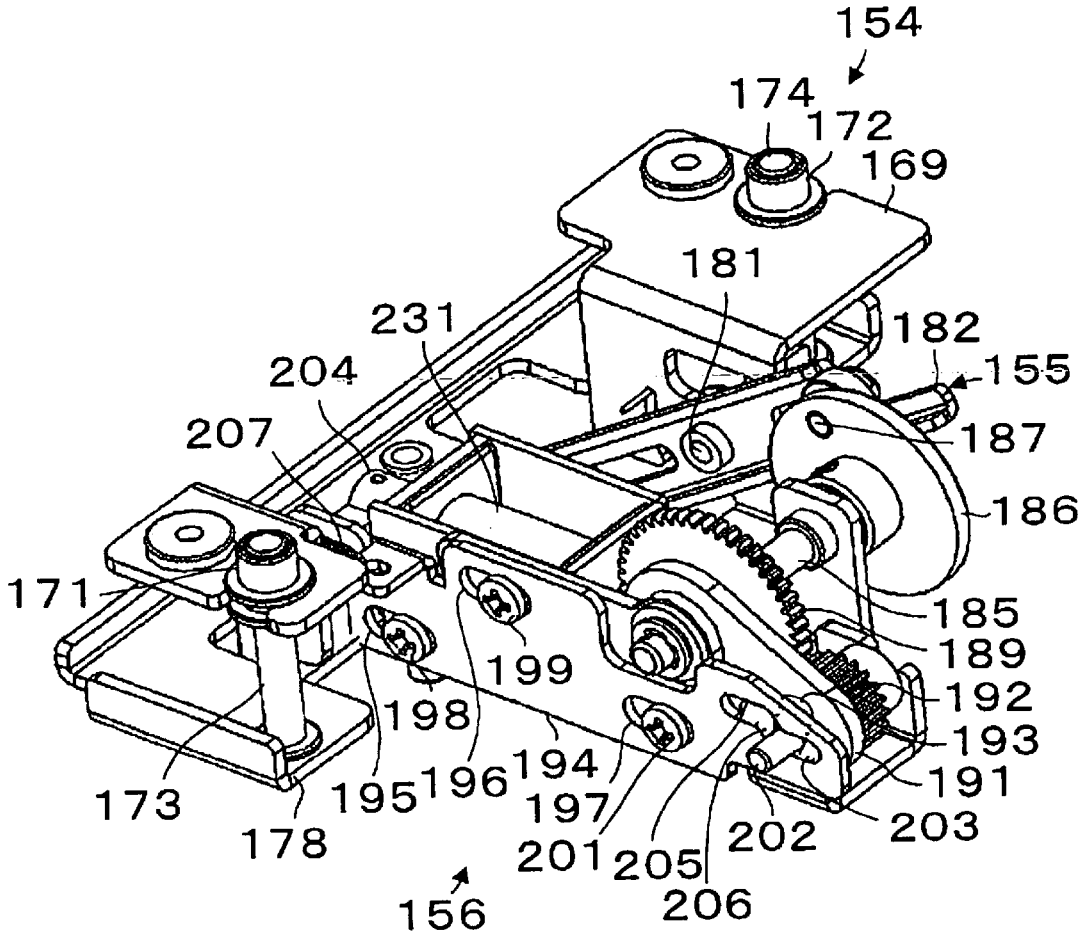
FIG. 11 is a perspective view of a lift driving.

The driver 156 of the lifting driver 155 is explained as shown in FIG. 11. A driven gear 189 is fixed at the rotating shaft 185. The rotating shaft 185 is rotatable and is supported at a fourth bracket 191. A pinion gear 192 is fixed at a shaft 202 and engages with the driven gear 189. The shaft 202 penetrates into an elongated hole 193 in the vertical direction at the fourth bracket 191.

Screws 198, 199, and 201 are screwed into the fourth bracket 191 and penetrate each elongated holes 195, 196 and 197. A cam board 194 can slide along the fourth bracket 191 by the screws 198, 199 and 201 and the elongated holes 195, 196 and 197.

The shaft 202 penetrates in a cam hole 203 which is crank shape and is located at the end of the cam board 194. The cam hole 203 includes a horizontal section 205 and a slanting section 206. When the slanting section 206 pushes the shaft 202 towards the right, as shown in FIG. 11, the pinion gear 192 engages with the gear 143.

A third solenoid 231 is fixed at the fourth bracket 191. A core 204 of the third solenoid 231 is fixed at the cam board 194. The cam board 194 is drawn towards the left, as shown in FIG. 11, by a spring 207 which is hooked to the fourth bracket 191. When the cam board 194 is drawn towards to the left by spring 207, the pinion gear 192 engages with the driven gear 189 and does not engage with the driving gear 143 (shown in FIG. 8).

When the third solenoid 231 is excited, the cam board 194 moves towards the right, as shown in FIG. 11. Therefore, the cam board 194 pushes up the shaft 202 by the slanting section 206. As a result, the pinion gear 192 engages with the driving gear 143. As shown in FIG. 11, the driver 156 and the first roller 21 are driven by the first motor 134 through the first transmission mechanism 135.

Next, a driving mechanism 232 of the one-by-one dispensing device 96, and the first transporting roller 18 is explained. As shown in FIG. 8, a second worm gear 239 which is fixed at the output shaft of a second motor 234 engages with a second worm wheel 241, which is rotatable, and is supported on a fixed shaft 240.

The gear (not shown) which is fixed at the second worm wheel 241 engages with a gear 243 which is fixed at the driving shaft 112. The gear 243 engages with the first gear 22 which is fixed at the side of the first roller 21.

As shown in FIG. 5, a gear 245 is fixed on a shaft 244 of the one-by-one dispensing device 96 and is driven by a gear 247 through to an idlerr gear 246. Therefore. the roller 101 of the one-by-one dispensing device 96 is driven by the second motor 234 through to the one-way clutch 111.

Figure 12:
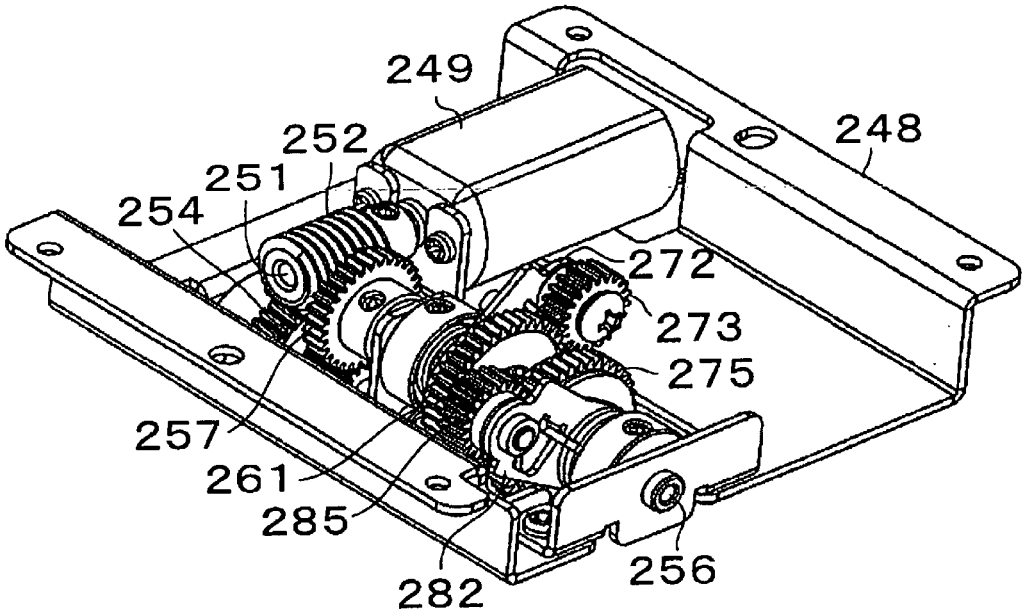
FIG. 12 is a perspective view of the driving device, the let-off device, and the receiving device.
Figure 13:
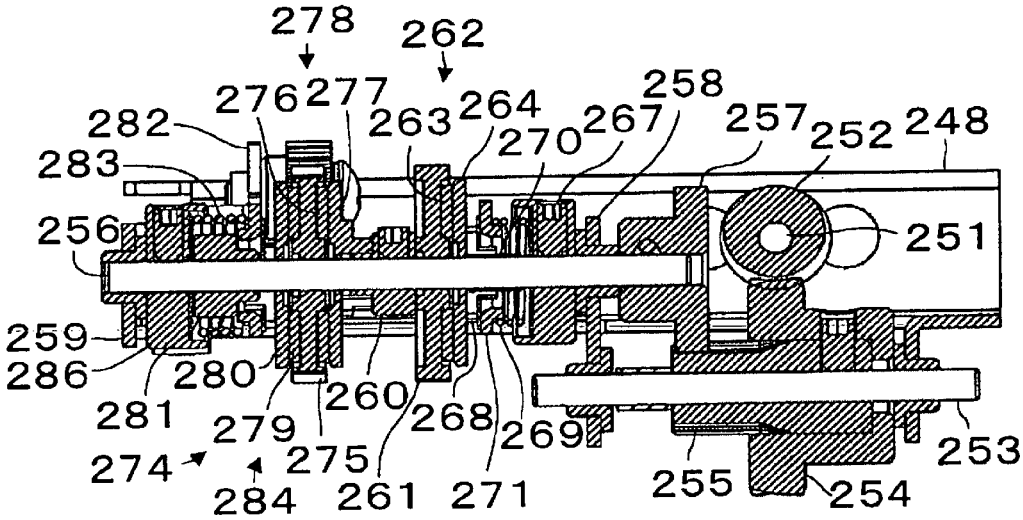
FIG. 13 is a cross-section view of the driving device, the let off device and the receiving device.

Next, the driving device 17 of the let-off device 3 is explained by referring to FIG. 12 and FIG. 13. A fourth motor 249 is fixed at bracket 248. A worm gear 252 is fixed on an output shaft 251 of the fourth motor 249.

The third worm gear 252 engages with a third worm wheel 254 which is fixed on a shaft 253 which is rotatable and supported at the bracket 248. A pinion gear 255 which is integrated with the third worm gear 252 to engage with a gear 257, which is fixed at a shaft 256, which is also rotatable and supported on the bracket 248.

The second shaft 256 is rotatable and supported on a pair of bearings 258 and 259. A first stopper 260 is fixed at the middle of the second shaft 256. A drive gear 261 is fixed on the second shaft 256 and is located adjacent to the first stopper 260.

A first slipping disc 263 is a ring and is fixed at the side of the drive gear 261. A second slipping disc 264 is a also ring and is rotatably supported at the second shaft 256 and is located adjacent to the first slipping disc 263.

The friction disc (not shown) is made from felt and is wedged between the first slipping disc 263 and the second slipping disc 264. The first slipping clutch 262 is made up of the first slipping disc 263, the second slipping disc 264 and the friction disc.

A first pusher 268 is a cylinder with a flange and is located between a second stopper 267 and the second slipping disc 264. The second stopper 267 is fixed on the second shaft 256 which is located between the bearing 258 and the second slipping disc 264. A spring 269 is located between the first pusher 268 and the second stopper 267. Therefore, the second slipping disc 264 is pushed towards the first slipping disc 263 by the spring 269.

A second spring 270 is wound around the second shaft 256 which forms the second one-way clutch and comes face to face with the first pusher 268. When the second shaft 256 doesn't rotate, the second spring 270 rotates to the second shaft 256.

When the second shaft 256 rotates in the involute direction of the second spring 270, the inner surface of the second spring 270 has a frictional contact with the exterior surface of the second shaft 256. Therefore, the second spring 270 is caught in the second shaft 256, and as a result, the bore diameter of the second spring 270 becomes slightly smaller. Thus, the second spring 270 has hard contact with the second shaft 256 and rotates integral with the second shaft 256.

The second slipping disc 264 rotates integral with the second shaft 256 because the end of the second spring 270 hooks to a slit 271 of the second slipping disc 264. The transmission force from the second slipping disc 264 to the first slipping disc 263 is determined by the pushing force of the spring 269 and the coefficient of the sliding friction between the first slipping disc 263 and the second slipping disc 264. The drive gear 261 engages with an idler gear 273 which is rotatably supported on a first cantilever 272 which is extended from the first pusher 268.

A drive changing device 274 can be seen in FIGS. 12 and 13. The drive changing device 274 includes a receiving driving gear 275, a second slipping clutch 278, a second cantilever 282, a third slipping clutch 284, a receiving idler gear 285. A third stopper 286 is fixed at the second shaft 256 and is located adjacent to the bearing 259. The receiving driving gear 275 is rotatable and is supported at the second shaft 256 and is located between the drive gear 261 and the third stopper 286.

The second slipping clutch 278 includes a third slipping disc 276 that is rotatable and is supported at the side of the receiving driving gear 275. A fourth slipping disc 277 is rotatable supported on the second shaft 256 and is located between the first stopper 260 and the third slipping disc 276.

The second friction disc (not shown) is a ring and is made from felt and is wedged between the third slipping disc 276 and the fourth slipping disc 277. The second slipping clutch 278 includes the third slipping disc 276, the fourth slipping disc 277, and the friction disc.

The third slipping clutch 284 is explained. A fifth slipping disc 279 is fixed at the side of the receiving driving gear 275. A sixth disc 280 is rotatable and is supported on the second shaft 256 and is located between the third stopper 286 and the fifth slipping disc 279. A third friction disc (not shown) is a ring and is made from felt and is wedged between the fifth slipping disc 279 and the sixth disc 280.

A ring 281 is rotatable and is supported on the second shaft 256. The second cantilever 282 is fixed at the ring 281. A spring 283 is located between the third stopper 286 and the second cantilever 282 and pushes the second cantilever 282 towards the side of the receiving driving gear 275. The third slipping clutch 284 includes the fifth slipping disc 279, the sixth disc 280, and the friction clutch.

The sixth disc 280 is pushed towards the side of the fifth slipping disc 279 by the spring 283 through to the second cantilever 282. The receiving idler gear 285 is rotatable and is supported on the end of the second cantilever 282. The receiving idler gear 285 engages with the receiving driving gear 275.

When the first cantilever 272 and the second cantilever 282 pivot on the second shaft 256, the idler gear 273 and the receiving idler gear 285 can be engaged with the gear 126 which is located at the unit section 115 of the safe 2. When the second shaft 256 rotates in the counterclockwise direction, as shown in FIG. 12, the second spring 270 becomes smaller in diameter because the second spring 270 has contact with the second shaft 256. Therefore, the one way clutch is connected. As a result, the first pusher 268 rotates towards the same direction.

The second slipping disc 264 rotates towards the same direction of the first pusher 268. Accordingly, the first slipping disc 263 is rotated towards the same direction at a predetermined torque which is installed in the first slipping clutch 262. In this situation, the first cantilever 272 also rotates towards in the same direction, therefore the idler gear 273 engages with the driven gear 126.

The fourth slipping disc 277 rotates in the same direction through to the first stopper 260. The sixth disc 280 rotates in the same direction through to the third stopper 286, the spring 283, and the second cantilever 282. Therefore, the receiving driving gear 275 rotates in the counterclockwise direction at a predetermined torque which is installed in the second slipping clutch 278 and the third slipping clutch 284.

The receiving idler gear 285 does not engage with the gear 126 because the second cantilever 282 rotates in the clockwise direction. Therefore, the gear 126 rotates in the counterclockwise direction at FIG. 1. The rollers 124 and 125 are rotated in the counterclockwise direction by the gear 126 through the belts 127 and 128. The lowest banknote 12 has contact with the rollers 124 and 125 and it is let off to the outside of the safe 2.

When the second shaft 256 rotates in the clockwise direction, as shown in FIG. 12, the second spring 270 becomes larger in diameter because the inner surface of the second spring 270 has friction contact with the second shaft 256. Thus, the one way clutch disconnects, and as a result, the drive gear 261 does not rotate. The idler gear 273 does not engage away from the gear 126 because the first cantilever 272 rotates in the clockwise direction, as shown in FIG. 12.

The receiving driving gear 275 rotates in the same direction through the second slipping clutch 278 and the third slipping clutch 284. At the same time, the receiving idler gear 285 engages with the gear 126 because the second cantilever 282 rotates in the same direction. Accordingly, the gear 126 rotates in the clockwise direction, as shown in FIG. 1. The rollers 124 and 125 are rotated in the clockwise direction by the gear 126 through the belts 127 and 128. The rollers 124 and 125 can draw the banknote 12 into the safe 2 because they rotate in a clockwise direction. Therefore, the rollers 124 and 125 can function either as a let-off device 3 or a receiving device 99 for the safe depending on the rotating direction. The drawing device 152 includes the rollers 124 and 125 and the drive changing device 274.

A driving device 288 of the package dispensing device 53 is explained. As shown in FIG. 1, the guiding roller 57 is rotated by a third motor 289.

The layout of the sensors is now explained. First, a banknote sensor is explained. A first sensor 291 is located at the outside of a shutter 299. A second sensor 292 is located at the receiving slot 19. A third sensor 293 is located at the first transporting passage 35. A fourth sensor 294 is located at the section of the fourth roller 51. A fifth sensor 295 is located at the reject transporting roller 74. A sixth sensor 296 is located at the banknote dispensing slot 5. A seventh sensor 297 is located at the recycling passage 7.

The distance between the first sensor 291 and the third sensor 293 is the same length as the length of a banknote 12. A length sensor 298 includes the first sensor 291 and the third sensor 293. The second sensor 292 is a transparent photoelectric method sensor and has the function of passing the sensor and the duplicate sensor. A checking sensor 302 is the second sensor 292.

The banknote sensor can be changed to a reflecting type or a mechanical type.

The position sensor 303 detects the first projection 61 and the second projection 62 in the tray 16. As shown in FIG. 10, a position sensor 306 is a proximity sensor and detects to the lifted guide rod 177.

Figure 14:
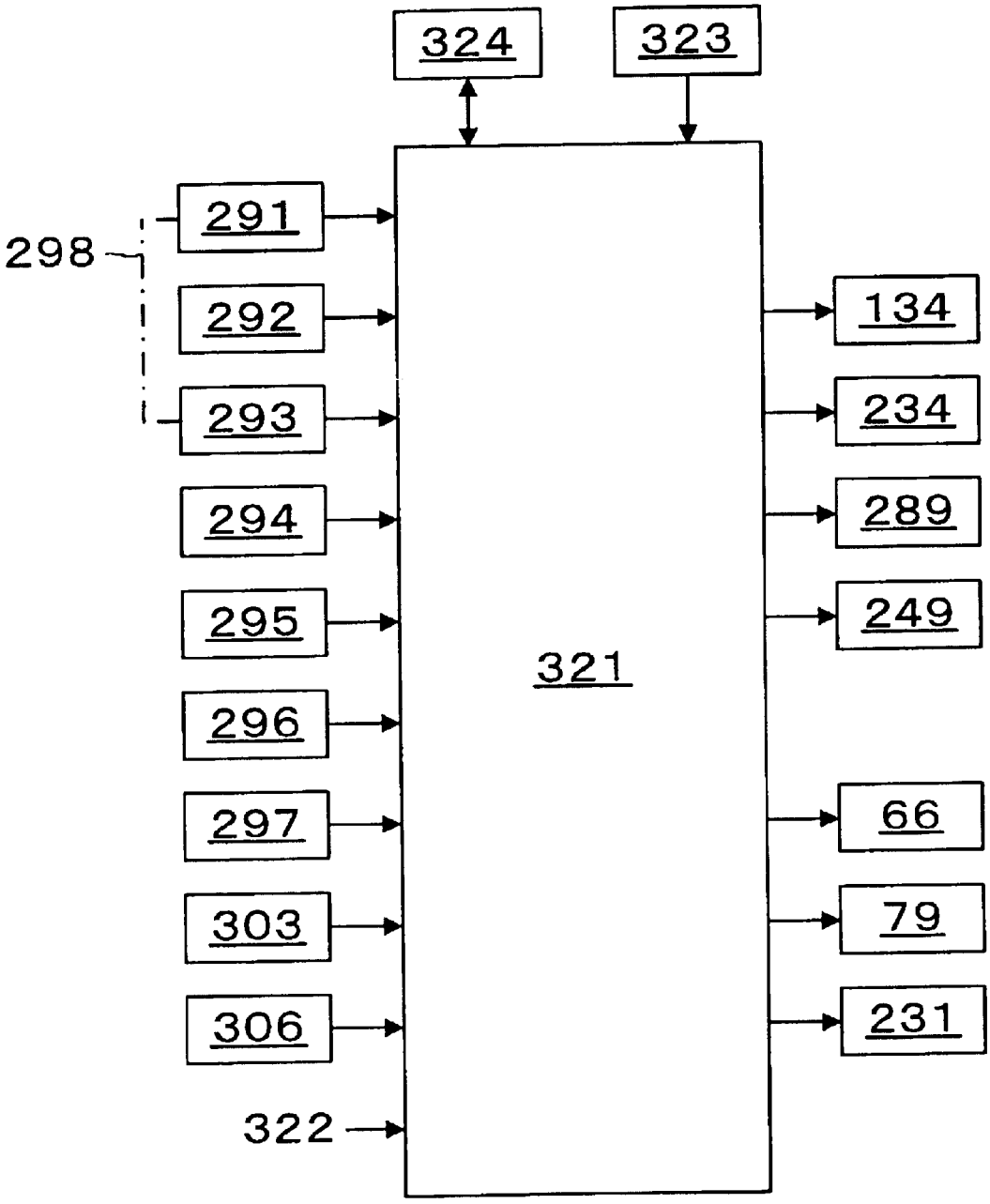
FIG. 14 is a schematic control block diagram of the present invention.

Next, a control block diagram is explained by referring to FIG. 14. The banknote sensors 291 through to 297, the position sensors 303 and 306 are connected to a micro computer 321. A payout signal 322 from an exchanger is inputted into the micro computer 321.

The micro computer 321 operates based on a program stored in ROM 323 and communicates with the RAM 324, and controls the first motor 134, the second motor 234, the third motor 289 fourth motor 249, the solenoid 66, the second solenoid 79, and the third solenoid 231.

Next, the operation of an embodiment of the present invention is explained by referring to flow charts shown in FIG. 15 through FIG. 18. At a situation where the safe 2 is removed from the storing section 11, the banknotes 12 are stored in the storing section 113 in a stacked array. The lid 117 is closed and is locked by the key 119.

The banknote pusher 129 pushes the stack of banknotes 12 towards the bottom 157 of the storing section 113. The lowest banknote 12 is driven into contact with the rollers 124 and 125. The safe 2 is inserted into the storing section 11 and is locked to the body 10 by a locking device (not shown).

Figure 15:
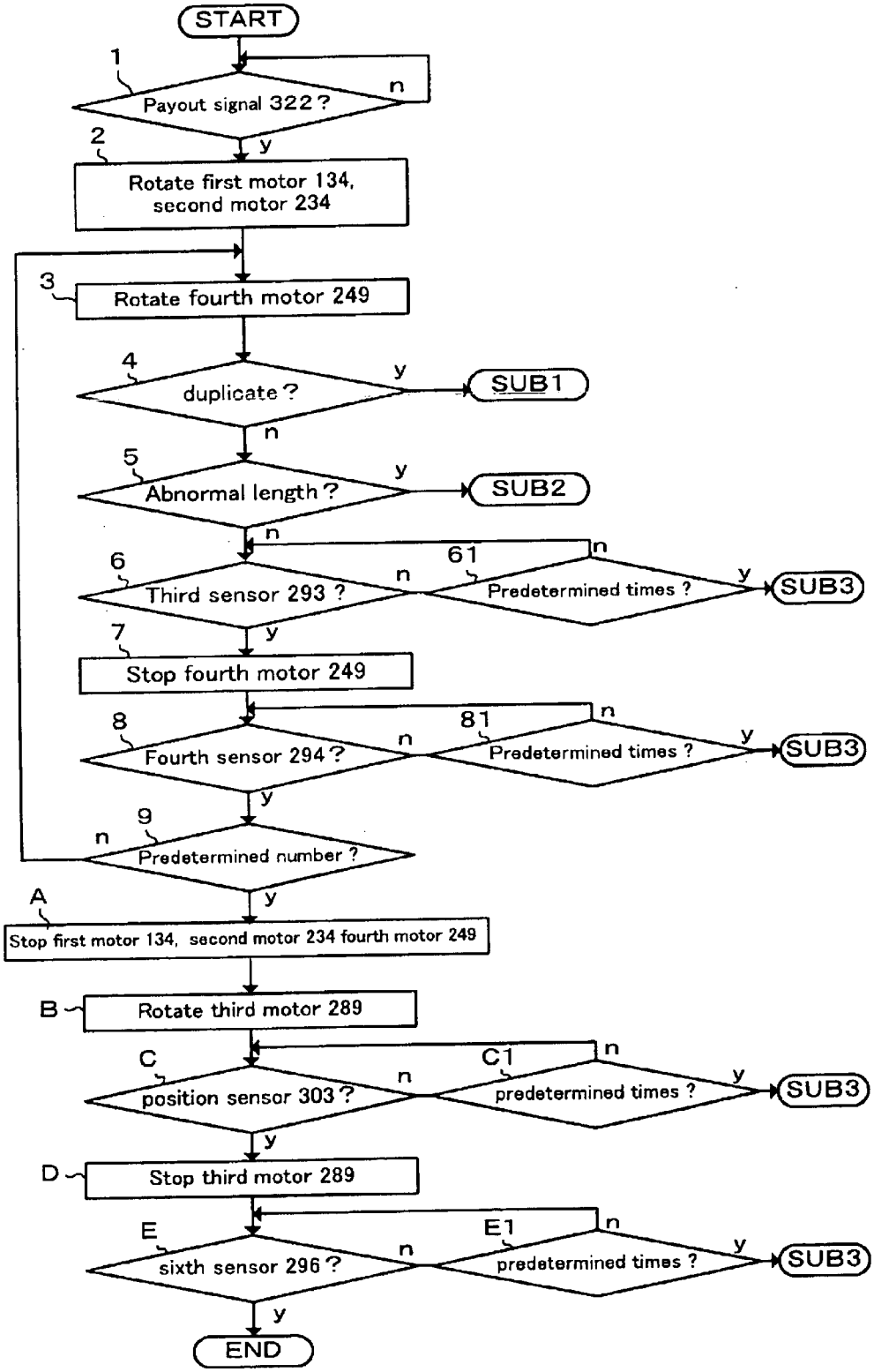
FIG. 15 is a flow chart to explain the operation of the present invention.

Next, an operation, where a banknote 12 is paid out is explained in FIG. 15. At step 1, when the payout signal from a control circuit of, for example, a vending machine, etc. is received, the operation proceeds to step 2 where the first motor 134 and the second motor 234 are rotated.

When the first motor 134 rotates, the second roller 25 rotates in the clockwise direction to the first transmission mechanism 135 and the second gear 26. The first arraying roller 41, the third roller 28, the fourth transporting roller 51, the fifth roller 76, and the second arraying roller 83 are rotated in the same direction by the second gear 26.

The first transporting roller 18, the first arraying roller 41, and the fourth roller 51 rotate for the banknote 12 to be transported to the second storing device 16. The reject transporting roller 74 rotates if a sensor rejects the banknote 12 to the reject storing section 114.

The second arraying roller 83 can rotate and sends banknote 12 to a recycle storing device 73. First gear 22 is rotated in a clockwise direction by the second motor 234 through the second driving mechanism 212. Therefore, the first roller 21 rotates to send the banknote 12 to the first transporting device 14.

At step 3, the fourth motor 249 rotates. The second shaft 256 is rotated in a counterclockwise direction, as shown in FIG. 12 by the fourth motor 249 through the third worm gear 252, the third worm wheel 254, the pinion gear 255, and the gear 257.

The second spring 270 is rotated by the second shaft 256 which rotates in a counterclockwise direction, and screws the second shaft 256 up tight, and as a result, and the second slipping disc 264 rotates. The first slipping disc 263 is rotated to the predetermined torque through the friction disc.

The first cantilever 272 and the first pusher 268 are pivoted in a counterclockwise direction by the second shaft 256. Therefore, the idler gear 273 engages with the driven gear 126 in the unit section 115. In this situation, the second cantilever arm 282 rotates in the same direction by the rotation of the counterclockwise direction of the second shaft 256. The receiving idler gear 285 does not engage with the driven gear 126.

The rollers 124 and 125 are rotated in a counterclockwise direction by the driven gear 126 through the belts 127 and 128. The lowest banknote 12 is sent to the banknote exit 123 by the rollers 124 and 125.

Only one banknote 12 should pass through the banknote exit 123 and be transported to the receiving slot 19. The banknote 12 is transported to the first transporting passage 35 by the second transporting roller 23 and goes through the first transporting roller 18 and it arrives at the first arraying device 36.

The banknote 12 is transferred from the second transporting roller 23 to the first arraying roller 41, shortly after the banknote 12 passes from the second transporting roller 23. The first arraying roller 41 pushes at a predetermined force to the banknote 12 to the first guiding board 34. The cylindrical section 44 and the slanting section 45 which is the first arraying roller 41 have contact with the banknote 12, because it has deformation. The banknote 12 which moves upwards, as shown in FIG. 2, is turned in a clockwise direction, because it is guided by the first arraying roller 41 and the first guiding board 34. Therefore, the contact pressure of the cylindrical section 44 to the banknote 12 is larger than the contact pressure of the slanting section 45, and as a result, the banknote 12 receives a turning force by the cylindrical section 44. The lower end of the side edge 49 of the banknote 12 has contact with the third guide wall 38 by the turn.

The banknote 12 is turned in a clockwise direction as it fulcrums at the lower end. Accordingly, the side edge length of the banknote 12 has contact with the third guide wall 38. Afterwards, the side edge 49 of the banknote 12 is guided by the third guide wall 38 and arrives at the third transporting roller 27. After the banknote 12 is nipped by the third transporting roller 27, it goes off from the first arraying roller 41. At the third transporting roller 27, the running direction of the banknote 12 is changed to a right angle by the third press roller 29 and the fourth press roller 31.

At step 4, the second sensor 292 distinguishes any overlap of the banknotes 12. The output signal of the second sensor 292 which is a transmission type compares to a standard level. As a result, if banknotes are duplicated, it gets detected. When a dispensed duplicate banknote 12 is detected, the program goes to step 11 of the subroutine SUB1. When the dispensed duplicate banknotes 12 are not detected, the program goes to step 5, and the length of the banknote 12 is judged.

The distance between the first sensor 291 and the third sensor 293 is slightly longer than the length of the banknote 12. Therefore, if the first sensor 291 and the third sensor 293 output a detecting signal at the same time, it is an abnormal situation, and as a result the program goes to step 21. If it is a normal situation, the program goes to step 6.

At step 6, a signal of banknote 12 from the third sensor 293 is judged. In other words, when the dispensed banknote 12 from the safe 2 is detected, the program goes to step 7. At step 7, the fourth motor 249 is stopped, as a result, the let off of banknote 12 from the safe 2 is stopped.

At step 61, if the banknote signal is detected over a set predetermined time, the program goes to step 31 because a jam has occurred.

Figure 18:
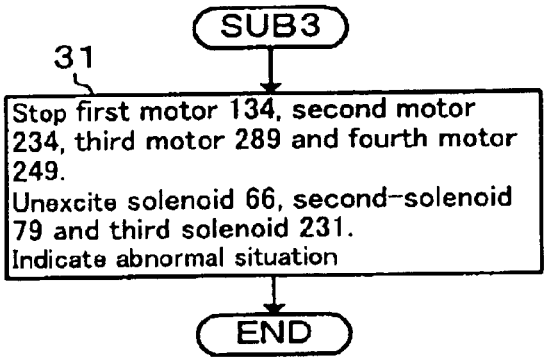
FIG. 18 is the flow chart to explain the operation of still another subroutine.

At step 31, all actuators (first motor 134 and second motor 234, etc.) are stopped, as shown in FIG. 18, and an abnormal sign is displayed to a display panel, and all processes are stopped.

Next, at step 8, the banknote detecting signal of the fourth sensor 294 is determined. When a banknote detecting signal is not provided, it is judged a normal situation and the program goes to step 9. At step 8, when the banknote signal is detected over a predetermined time, the program goes to SUB3 because a jam has occurred, which results in an abnormal process.

If it is a genuine banknote, the diverting board 65 is kept at the solid line in FIG. 1. Therefore, the banknote is guided to the fourth roller 55 by the diverting board 65 while wedged between the fourth press roller 31 and the third roller 28. The fourth roller 55 transports the banknote 12 to the storing device 16 which is located between the concave portion 56 of tray 50 and the second transporting device 15.

At step 9, when counted, the banknote signal which is outputted from the fourth sensor 294, (the program), the program goes to step A. In the other words, the banknotes 12 which are stored at predetermined numbers in the second storing device 16, are checked. If the banknote signal is not a predetermined number, the program returns to step 3, and a second banknote 12 is dispensed from safe 2. This process is repeated until a predetermined number of banknotes are released from the safe 2.

At step A, the first motor 134, the second motor 234, and the fourth motor 249 are stopped. As a result, the let-off device 3, the first transporting roller 18, and the first transporting device 14 stop.

At step B, the third motor 289 rotates. Guiding roller 57 is rotated in the counterclockwise direction as shown in FIG. 1. At step C, when position sensor 303 detects second projection 62, the program goes to step D. At step D, third motor 289 stops, and the program goes to step E. At step C, when sensor 303 doesn't output a second projection 62 detecting signal within a predetermined time period, the program goes to subroutine SUB3 and it executes a trouble shooting mode of operation.

Finally, the banknotes 12, in storing device 16, are moved to the banknote dispensing slot 5, and as a result one end of the banknotes 12 protrude from between the guiding boards 63 and 64.

At step E, when the sixth sensor 296 detects the banknotes 12 within an appropriate time period, the program goes to the next step. As a result, the program is stopped. If the sixth sensor 296 doesn't detect the banknotes 12 at step E1, the program goes to subroutine SUB3, and the program executes the trouble shooting mode of operation.

The protruding banknote 12 from the guiding boards 63 and 64 can be removed by a user. When the banknotes 12 are not pulled by a person within a predetermined time period, an alarm can be activated to get someone's attention.

Figure 16:
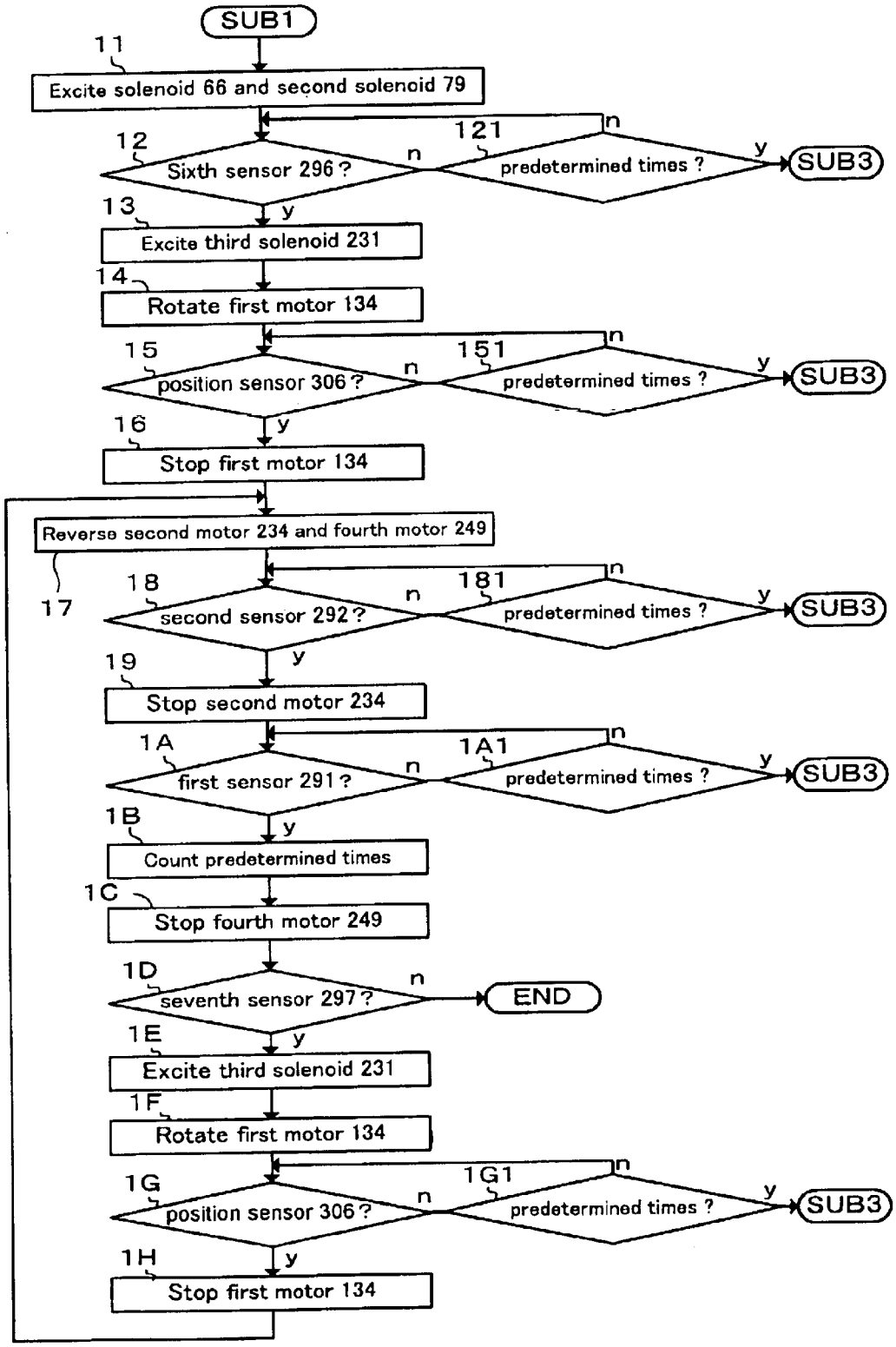
FIG. 16 is a flow chart to explain the operation of a subroutine.
Figure 17:
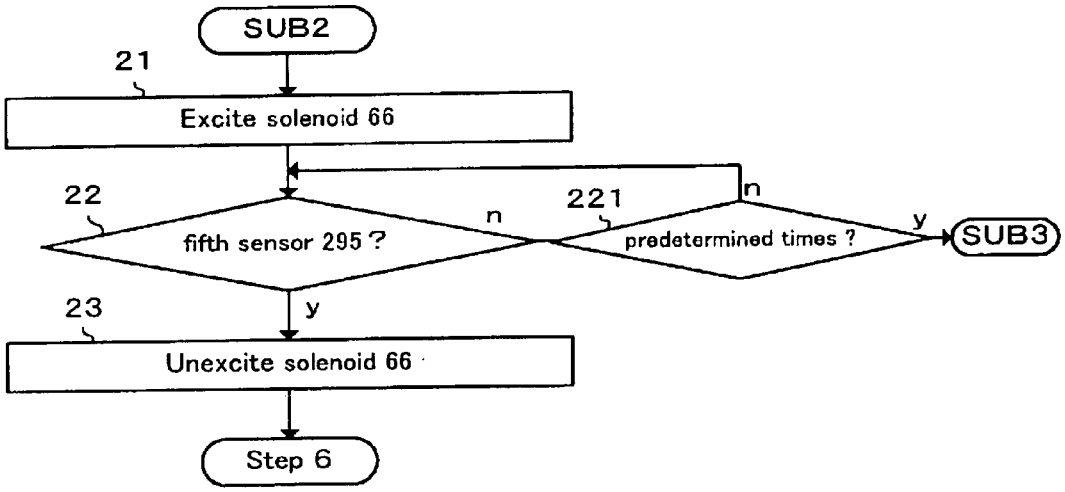
FIG. 17 is the flow chart to explain the operation of another subroutine.

When overlapping banknotes 12 are detected at step 4, the solenoids 66 and the second solenoid 79 are excited at step 11 of subroutine SUB1 (shown in FIG. 16). The diverting board 65 slightly pivots in a clockwise direction by the solenoid 66 at step 11 and closes the passageway to the fourth roller 55 and opens the passage way to the recycling passage 7. Also, the reject guiding board 78 is slightly pivoted in a clockwise direction by the second solenoid 79 and closes the passagway to the reject transporting roller 74 and opens the passageway to the recycling passage 7.

Therefore, the banknotes 12 are guided by the diverting board 65 and is guided by the reject guiding board 78. While the banknotes 12 are wedged between the third roller 28 and the fourth press roller 31, the banknote 12 arrives at the second arraying device 72. The recycling banknotes 80 are pushed to the reverse surface 67 by the spring 87 at the second arraying device 72, afterwards it is wedged between the second arraying roller 83 and the reverse surface 67. The recycling banknotes 80 are wedged between the second arraying roller 83 and the reverse surface 67, and pass between the third roller 28 and the fourth press roller 31. The recycling banknotes 80 are changed in the position by the second arraying roller 83 to be the same as the first arraying roller 41 and the sides are pushed to the third guiding wall 86 and are arrayed.

Therefore, the end of the recycling banknotes 80 are stopped by the overlap section 108 which is located between the fixed rollers 103 and 104 and the seventh press roller 102. As a result, the recycling banknotes 80 are temporarily stored in the recycle storing device 73. In this situation, the second arraying roller 83 has contact with the upper section of the recycling banknotes 80. However, the second arraying roller 83 cannot be rotated because the friction clutch 94 slips.

Therefore, the recycling banknotes 80 are not injured by the rotation of the second arraying roller 83, because the transfer of the torque of the friction clutch 94 is set. Also, the banknotes 12 do not become distorted, e.g., bent into a wave shape. In this situation, the spring 87 pushes the upper section of the recycling banknotes 80 to the first guiding board reverse side 67.

Subsequently, the recycling banknotes 80 are transported to the recycle storing device 73, while the recycling banknotes 80 are stored at the recycle storing device 73. The end of the next recycling banknote 80 is guided to the base of the spring 98 by the slanting surface 97 (shown in FIG. 1). The end of the recycling banknotes 80 are guided by the slant of the spring 98 and has contact with the stored recycling banknotes 80 from the side of the safe 2. Therefore, the next recycling banknotes 80 are pushed to the stored recycling banknote 80 by the end of the spring 87.

Next, the recycling banknote 80 is arrayed by the second arraying roller 83 and the third guiding wall 86. In this manner, the recycling banknotes 80 are arrayed at the safe 2 side.

At step 12, when the banknotes 12 are extracted from the banknote dispensing slot 5, the output of the sixth sensor 296 becomes "ON" and the program goes to step 13. If the sixth sensor 296 outputs the banknote detecting signal over a predetermined time period, at step 121, the program goes to the subroutine SUB3 and executes the program for an abnormal situation.

At step 13, the third solenoid 231 is excited and core 204 moves to the right (as shown in FIG. 11), and as a result, the cam board 194 slides in the same direction. The slanting section 206 of the cam hole 203 pushes up the shaft 202 in the elongated hole 193 as a result of the sliding movement of the cam board 194. Pinion gear 192 engages with the driven gear 189 and the driving gear 143.

At step 14, the first motor 134 rotates. Crank 186 of the lifting driver 155, therefore, it pushes down the pin 187 and the lever 182. The lever 182 pivots in a counterclockwise direction, as shown in FIG. 10, and pushes down the pin 179.

The transferring base 178 moves upward from the position, shown in FIG. 11, to the position shown in FIG. 8, and at the same time, the first pushing rod 173 is guided by the bushing 171, the second pushing rod 174 is guided by the bushing 172, and the guiding rod 177 is guided by the bushing 176.

When the transferring base 178 moves to the most upward position at step 15, the position sensor 306 outputs a detecting signal and the program goes to step 16. When the position sensor 306 does not detect a signal over a predetermined time period at the step 151, the program goes to subroutine SUB3, because the lifting device 154 has not been pushed up.

At step 16, the first motor 134 stops. Therefore, the transferring base 178 is located in its most upward position. As a result, the first pushing rod 173 pushes up the first receiving section 163 of the banknotes lifting device 153, and the second pushing rod 174 pushes up the second receiving section 168.

Figure 19:
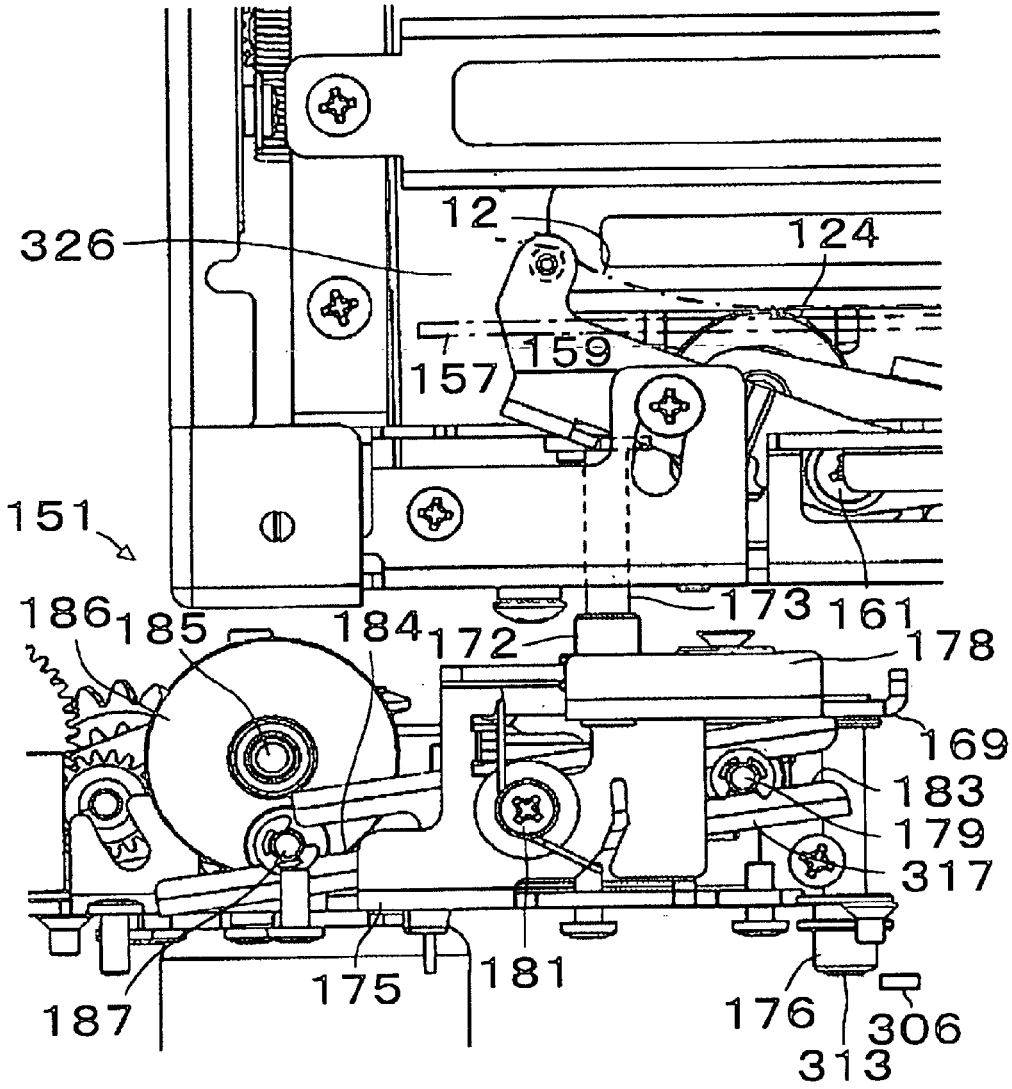
FIG. 19 is a front view to explain the operation of the lifting device of the present invention.

Therefore, the first lever 159 and the second lever 164 pivot in a clockwise direction on each shaft 161 and shaft 165, as shown in FIG. 19, and push upward the first pin 162 and the second pin 166. The first pin 162 and the second pin 166 push the banknote 12 upwards. Therefore, they create a recycled banknote receiving section 326 which has a triangular shape.

At step 17, the second motor 234 and the fourth motor 249 are reversed in rotation. The first roller 21 rotates in a counterclockwise direction by the second motor 234 through the second driving mechanism 232 and the first gear 22, as shown in FIG. 1.

The driving shaft 112 rotates in a counterclockwise direction through the gear 243, the idler gear 246, and the gear 245 by the second motor 234, as shown in FIG. 5. Therefore, the diameter of the spring of the one-way clutch 111 contracts to grasp the driving shaft 112. As a result, the one-way clutch 111 lets in the clutch and rotates the shaft 100 in the same direction. The roller 101 rotates in a counterclockwise direction by the shaft 100, as shown in FIG. 6.

The seventh press roller 102 has contact with the roller 101 and rotates in a clockwise direction. Therefore, only the recycling banknote 80, which has contact with the seventh press roller 102, is pulled down and is let off towards the side of the first transporting roller 18 by the roller 101.

The recycling banknote 80 is guided to a point of contact between the first roller 21 and the first pressing roller 20 by the guiding board, and is guided to the banknote exit 123 through the receiving slot 19. The second shaft 256 rotates in a clockwise direction by the fourth motor 249, as shown in FIG. 12.

Therefore, the idler gear 273 is disengaged from the driven gear 126, because the first cantilever arm 272 rotates in a clockwise direction. Also, the spring 269 is increased in its inner diameter to permit rotation of the second shaft 256. Therefore, the drive gear 261 does not rotate.

The receiving idler gear 285 engages with the driven gear 126, because the second cantilever 282 is pivoted in a clockwise direction by the second shaft 256. Therefore, the receiving driving gear 275 rotates in a clockwise direction by a predetermined torque which is set by the second slipping clutch 278 and the third slipping clutch 284. The rollers 124 and 125 rotate in a clockwise direction through the receiving idler gear 285, the driven gear 126, and the belts 127 and 128, as shown in FIG. 1.

Therefore, the end of recycling banknote 80, which is transported from the banknote exit 123 to the storing section 113 by the first transporting roller 18, goes between the roller 124 and the banknote 12 passes through the banknote receiving section 326. The recycling banknote 80 is transported between the roller 125 and the banknote 12 by the roller 124 The end of the recycling banknote 80, which has now been returned to the safe, is stopped by the lid 117. As a result, the rollers 124 and 125 stop rotating, because the rotating resistance of the roller 124 and 125 increases, and the second slipping clutch 278 and third slipping clutch 284 now slip. As a result, the recycling banknote 80 does not receive any damage nor is it undulated in shape by the rollers 124 and 125.

When the second sensor 292 does not detect a banknote signal at step 18, the program goes to step 19. If the; second sensor 292 does not output the banknote signal within a predetermined time period at step 181, the program goes to subroutine SUB3. At step 19, the second motor 234 stops. Therefore, the one-by-one dispensing device 96 and the first transporting roller 18 stop their operation.

When the first sensor 291 does not detect a banknote 12 at the step 1A, the program goes to step 1B. At step 1A1, the first sensor 291 does not detect a banknote signal within a predetermined time period and the program goes to subroutine SUB3. At step SUB3, this activates a mode of operation to address an abnormal situation. At step 1B, after a predetermined clocking, the program goes to step 1C, therefore the fourth motor 249 stops. As a result, the receiving device 99 operates within enough time to permit the recycling banknote 80 to be stored in the storing section 113.

At step 1D, when the seventh sensor 297 detects the recycling banknote 80, the program goes to step 1E. In other words, when the recycling banknote 80 is at the recycle storing device 73, it is prepared to receive the banknote 80. When there is not a recycling banknote 80 at the recycle storing device 73, the program finishes its operation.

At step 1E, the third solenoid 231 is excited. Next, the first motor 134 rotates at the step 1F. When the position sensor 306 does not detect the guiding rod 177 at the step 1G, the first motor 134 stops at step 1H. When the signal of the position sensor 306 is not detected within a predetermined time period, the program goes to subroutine SUB3 at step 1G1, to address an abnormal situation Therefore, the lifting device 154 and the banknote lifting device 153 move downward, and move upward. As a result, a receiving section 326 is formed between the lowest recycling banknote 80 and the bottom 157. At step 17, other recycled banknotes 80 are stored in the safe 2.

When a payout signal 322 is outputted, the first and lowest of the recycling banknotes 80, which has contact with rollers 124 and 125, is let off again from safe 2.

When the length sensor 298 detects an abnormal length of the banknote 12 at the step 5, the program goes to step 21 of subroutine SUB2 and the solenoid 66 is excited. Therefore, the diverting board 65 slightly pivots in a clockwise direction and closes the passageway to the fourth roller 55 and opens the passageway to the recycling passage 7 by the dotted line shown in FIG. 1.

At this situation, the second solenoid 79 is not excited. Therefore, the reject guiding board 78 closes the passageway to the recycling passageway 7 and opens the passageway to the reject transporting roller 74. The abnormal length banknote 12 is guided to the recycling passage 7 by the diverting board 65.

The banknote 12 is guided to the reject transporting roller 74 by the reject guiding board 78 and is transferred to the reject transporting roller 74, where it is transported by the third roller 28 and the fourth press roller 31. The banknote 12 is transported from the receiving slot 121 to the reject storing section 114 by the reject transporting roller 74. Therefore, the abnormal length banknote 12 is stored in the reject storing section 114.

When the output signal of fifth sensor 295 does not change within a predetermined time period at step 221, the program goes to subroutine SUB3. When the fifth sensor 295 does not output a signal at step 22, the solenoid 66 is not excited at step 23. Therefore, the diverting board 65 goes back to the solid line position, as shown in FIG. 1.

Next, the program goes to step 6. In another case, a pair of banknotes 12 may be misaligned.

In this situation, the banknotes 12 are judged by an abnormal situation at step 4 and 5. However, at step 4 priority sets in and it is calculated twice.

The lifter of this present invention can also be changed to adjust to the size of the banknotes. Also, when the banknotes are stored vertically, the lifter can move to the left and right. Therefore, the lifter has an ability and function to move the banknotes by itself from the receiving device.

Also, when the new banknotes are deposited, the present invention can be used. New banknotes, which are received from the receiving device, are transported to the recycle storing section, and afterwards they can be drawn into the safe by the operation of the lifter and the drawing device.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. In a dispensing device for storing banknotes in a safe unit and dispensing banknotes to a user, the improvement comprising:

a let-off unit for driving a stored banknote to exit from the safe unit;

a lifter unit for moving the stored banknotes remaining in the safe unit upward; and means for reversing the driving of the let-off unit, whereby a banknote presented at the exit side of the let-off unit can be drawn back into the safe unit when the lifter unit is activated.

2. The dispensing device of claim 1, wherein the let-off unit includes a pair of driven rollers.

3. The dispensing device of claim 2 further including a motor unit for driving the pair of driven rollers.

4. The dispensing device of claim 3, wherein the means for reversing includes a drive changing device operatively connected to the let-off device and the motor unit with a slipping clutch unit.

5. The dispensing device of claim 1, wherein the lifter unit includes at least one pin member for engaging beneath one end of the stored banknotes to raise that end to provide an entrance space to accommodate a drawing back of a banknote into the safe unit.

6. The dispensing device of claim 1, wherein the safe unit stores a vertical stack of banknotes and the let-off unit is located at the bottom of the safe unit.

7. The dispensing device of claim 5 further including a banknote pusher unit for biasing the stack of banknotes towards the let-off unit.

8. The dispensing device of claim 1 further including a recycle passageway unit for returning a banknote released from the let-off device to a position where the banknote has operative contact with the let-off unit.

9. The dispensing device of claim 8 further including a resistance guide unit for initially contacting a banknote and a rotatable driving roller that is positioned downstream of the resistance guide unit for subsequently pulling the banknote from the resistance guide unit whereby a duplicate banknote will be separated.

10. The dispensing device of claim 9, wherein the resistance guide unit includes two fixed curved surface members, positioned to be located respectively to sandwich the rotatable driving roller.

11. The dispensing device of claim 10, wherein the rotatable driving roller has a higher friction surface than the two fixed curved surfaced members.

12. In a dispensing device for storing banknotes in a storage unit and dispensing banknotes to a user through a discharge slot, the improvement of:

a transporting unit for transporting a banknote to be discharged, from an opening in the storage unit, along a first passageway to the discharge slot, including a let-off device for removing a banknote from the storage unit;

a monitor unit operatively positioned relative to the first passageway to monitor a condition of the transported banknote;

a diverting unit operatively connected to the monitor unit to remove a banknote from the first passageway when the monitor unit indicates duplicate banknotes;

a recycle transporting unit to return the duplicate banknotes to the opening in the storage unit; and a re-inserting unit for moving the duplicate banknote through the opening for again storing the duplicated banknote in the storage unit.

13. The dispensing device of claim 12, wherein the re-inserting unit includes a lifter unit for moving one end of the stored banknotes upward to provide a lower space and means for driving the let-off device to pull the duplicate banknote through the opening for storage in the storage unit.

14. The dispensing device of claim 13, wherein the lifter unit includes a pair of push rods for elevating a pair of pins to contact one end of the stored banknotes to provide the lower space to accommodate the re-insertion of the banknote into the storage unit.

15. The dispensing device of claim 12 further including an arraying device connected to the diverting unit upstream of the sorting device for aligning the banknotes.

16. The dispensing device of claim 15, wherein the arraying device includes biasing members for forcing a banknote in a specific direction and a rotating drive roller with a side slanting surface for aligning a banknote.

17. The dispensing device of claim 16, wherein the arraying device further includes a friction clutch and a power source for driving the rotating drive roller through the friction clutch.

18. In a dispensing device for storing banknotes in a storage unit and dispensing banknotes to a user through a discharge slot, the improvement comprising:

a transporting unit for transporting a banknote to be discharged, from an opening in the storage unit, along a first passageway to the discharge slot, including a let-off device for removing a banknote from the storage unit;

a monitor unit operatively positioned relative to the first passageway to monitor one of a normal situation and an abnormal situation and providing a signal indicative of an abnormal situation regarding the transported banknote;

a diverting unit operatively connected to the monitor unit to divert the transported banknote from the first passageway when the monitor unit indicates a signal of an abnormal situation;

a recycle transporting unit to return the diverted transported banknote to the opening in the storage unit; and a re-inserting unit for moving the diverted transported banknote through the opening for again storing the diverted transported banknote in the storage unit.

19. The dispensing device of claim 18, wherein the recycle transporting unit can receive new banknotes from a receiving device.

20. The dispensing device of claim 18, wherein the re-inserting unit includes a lifter unit for moving one end of the stored banknotes upward to provide a lower space and means for driving the let-off device to pull the diverted transported banknote through the opening for storage in the storage unit.

21. The dispensing device of claim 20, wherein the lifter unit includes a pair of push rods for elevating a pair of pins to have contact with one end of the stored banknotes to lower the area space and to accommodate the re-insertion of the banknote into the storage unit.

22. The dispensing device of claim 20, further including an arraying device connected to the diverting unit upstream of the sorting device for aligning the banknotes.

23. The dispensing device of claim 22, wherein the arraying device includes a biasing member for forcing a banknote in a specific direction and a rotating drive roller with a side slanting surface for aligning the banknotes.

24. The dispensing device of claim 22, wherein the arraying device further includes a friction clutch and a power source for driving the rotating drive roller through the friction clutch.

* * * * *